United States Patent [19]

Garnjost

[11] Patent Number: 4,840,111

[45] Date of Patent: Jun. 20, 1989

[54] ENERGY-CONSERVING REGENERATIVE-FLOW VALVES FOR HYDRAULIC SERVOMOTORS

[75] Inventor: Kenneth D. Garnjost, Buffalo, N.Y.

[73] Assignee: Moog Inc., East Aurora, N.Y.

[21] Appl. No.: 825,136

[22] Filed: Jan. 31, 1986

[51] Int. Cl.[4] ..... F15B 11/02; F15B 11/20

[52] U.S. Cl. ..... 91/436; 91/437; 91/459; 137/625.69

[58] Field of Search ..... 91/8, 9, 10, 436, 437, 91/, 471, 16, 18, 28, 29, 32, 33, 416, 420, 421, 438, 439, 440, 441, 459; 137/596, 625.69

[56] References Cited

U.S. PATENT DOCUMENTS

| | | | |
|---|---|---|---|
| 3,213,762 | 10/1965 | Dubuf | 91/441 X |
| 3,255,777 | 6/1966 | Rice et al. | 91/436 X |
| 3,273,468 | 9/1966 | Allen | 91/436 X |
| 3,357,451 | 12/1967 | Tennis | 91/436 X |
| 4,122,677 | 10/1978 | Budzich | 91/421 X |
| 4,139,986 | 2/1979 | Budzich | 91/436 X |
| 4,147,178 | 4/1979 | Budzich | 91/421 X |
| 4,180,098 | 12/1979 | Budzich | 91/421 X |
| 4,205,591 | 6/1980 | Mickelson | 91/420 X |
| 4,293,001 | 10/1981 | Budzich | 91/436 X |
| 4,411,189 | 10/1983 | Miller | 91/436 X |
| 4,434,708 | 3/1984 | Bowden | 91/436 |
| 4,555,974 | 12/1985 | Mason et al. | 91/436 X |
| 4,635,532 | 1/1987 | Tanino et al. | 91/436 |

FOREIGN PATENT DOCUMENTS

| | | |
|---|---|---|
| 52405 | 11/1981 | European Pat. Off. . |
| 3347000 | 7/1985 | Fed. Rep. of Germany . |

*Primary Examiner*—Robert E. Garrett
*Assistant Examiner*—George Kapsalas
*Attorney, Agent, or Firm*—Sommer & Sommer

[57] ABSTRACT

An improved energy-conserving servoactuator has at least one valve operatively associated with a double-acting fluid-powered actuator. When a load is applied to the actuator, the pressure in one actuator chamber will be greater than in the other. If the load is "opposing" with respect to the desired direction of actuator movement, fluid is supplied to the higher pressure chamber and is permitted to flow from the lower pressure chamber. However, if the load is "aiding" with respect to the desired direction of actuator movement, fluid in the higher pressure chamber is permitted to flow into the lower pressure chamber without drawing fresh fluid from the source.

89 Claims, 7 Drawing Sheets

Fig. 3a.
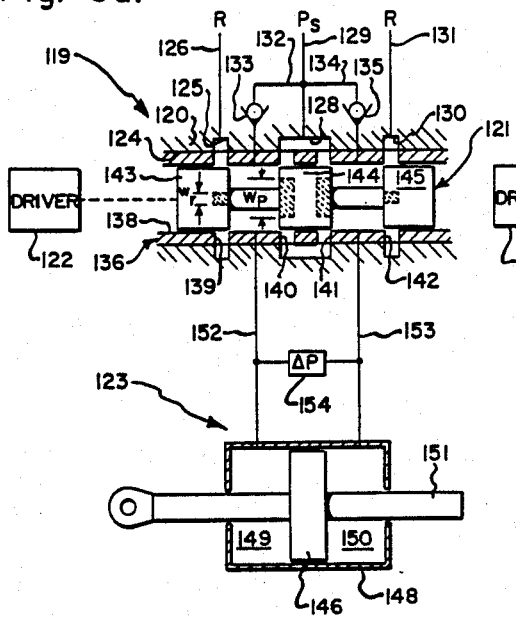
Fig. 3c.
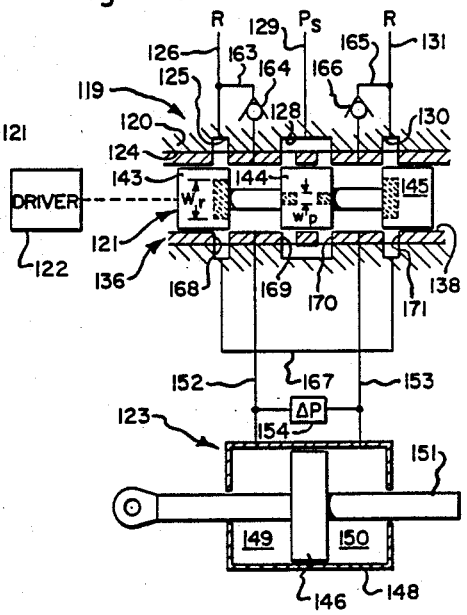
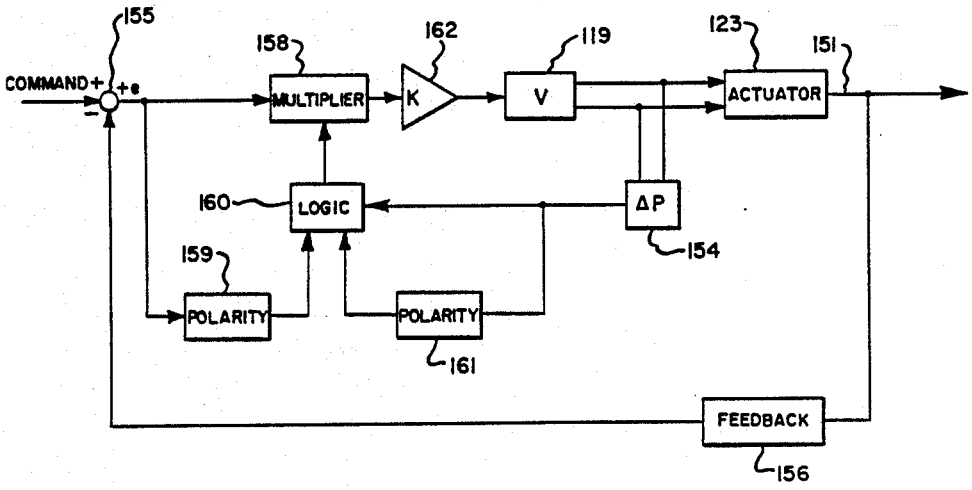
Fig. 3b.

ENERGY-CONSERVING REGENERATIVE-FLOW VALVES FOR HYDRAULIC SERVOMOTORS

BACKGROUND OF THE INVENTION

1. Field of the Invention

This invention relates generally to the field of servoactuators, and, more particularly, to improved energy-conserving servoactuators and several improved valves therefor.

2. Description of the Prior Art

Many types of servovalves have, of course, been developed heretofore. These servovalves have typically a spool slidably mounted within the bore of a body for controlling the flow of fluid between supply and return openings and one or more control openings. An electromechanical driver, such as a torque motor, was operatively arranged to move the spool relative to the body for creating a desired pressure at a control opening, or for creating a desired differential pressure between two control openings. The magnitude of such spool displacement was proportional to an error signal, which was the algebraic sum of a command signal (reflecting the desired spool position) and a negative feedback signal (reflecting the actual spool position). The polarity of the error signal determined the direction of spool movement relative to the associated body.

Such a servovalve was typically associated with a conventional doubleacting fluid-powered cylinder. The servovalve was used to control the flow of fluid to and from the opposing actuator chambers.

If it was desired to move the actuator rod against an "opposing" load, the servovalve was operated such that fluid could flow from the fluid source to the expanding actuator chamber, and could flow from the contracting actuator chamber to return.

However, if the actuator rod was moved in the same direction as an "aiding" load, the pressure in the actuator contracting chamber would be greater than the pressure in the actuator expanding chamber. The conventional servovalve controlled the position of the actuator rod by metering the flow of fluid from the contracting chamber. At the same time, however, fresh fluid from the source was admitted to the expanding chamber. This arrangement was inefficient because such fresh pressurized fluid did no useful work in controlling displacement of the actuator rod when the applied load was "aiding".

In many applications, it is sometimes desired to move an actuator rod in the same direction as an "aiding" load. For example, if a servomechanism is used to move an airfoil surface, the load on the actuator rod may be "opposing" if it is desired to move the load in one direction, but "aiding" if it is desired to move the load in the opposite direction. Similarly, in an active vehicle suspension system, the load may be "opposing" on a bound stroke, but "aiding" on a rebound stroke, or vice versa.

SUMMARY OF THE INVENTION

The present invention broadly provides improved energy-conserving servomechanisms and several improved valves therefor.

In one aspect, the invention provides an improved servomechanism (such as shown in FIG. 2*a*–2*d*) which is associated with a source of pressurized fluid at a supply pressure (e.g., $P_S$). The improvement includes a first valve (e.g., 71) and a second valve (e.g., 72). Each of these valves has one member (e.g., spools 85,85') movable relative to another member (e.g., bodies 74,74' and their associated sleeves 81,81'). Each of the other members has a supply opening (e.g., supply slots 84,84') communicating with the source, has a return opening (e.g., return slots 83,83'), and has a control opening (e.g., the point at which conduit 95 communicates with sleeve bore 82, and the point at which conduit 96 communicates with sleeve bore 82'). Each of the one members is movable (e.g., +x) within a first positional range relative to the associated other member to increase the pressure at the associated control opening, and is movable (e. g., −x) within a second positional range to decrease the pressure at the associated control opening. A first conduit (e.g., 99 in FIG. 2*a*, or 110 in FIG. 2*d*) communicates one of the first valve pressure and return openings with the like one of the second valve pressure and return openings. A first driver (e.g., 89) is operatively arranged to move the first valve one member to a desired position relative to the first valve other member. A second driver (e.g., 89') is operatively arranged to move the second valve one member to a desired position relative to the second valve other member. A sensor (e.g., 98) is arranged to determine the pressure differential at the first and second valve control openings. A controller (e.g., polarity sensors 103,106, logic unit 105, and multipliers 102,104) is operatively associated with the sensor and with the valve drivers for causing the first valve one member to move to an appropriate position (e.g., +x or −x) within one of its positional ranges and for causing the second valve other member to move to an appropriate position (e.g., −x or +x) within the other of its positional ranges when the pressure at one of the control openings is greater than the pressure at the other of the control openings, and for causing both of the first and second valve other members to move to appropriate positions (e.g., +x and +x, or −x and −x) within one of the position ranges when the pressure at the one control opening is less than the pressure at the other control opening.

In another aspect, and as shown in FIGS. 3*a*–3*c*, the invention provides an improved valve (e.g., 119) which is associated with a source of fluid. The improved valve includes a body (e.g., 120,136) provided with a bore (e.g., 138). The body has first and second supply openings (e.g., sleeve slots 140,141) and first and second return openings (e.g., sleeve slots 139,142) joining the bore. Each of the supply openings communicates with the source. A valve spool (e.g., 121) is mounted in the bore for longitudinal sliding movement relative thereto. The spool has first, second and third lobes, (e.g., 143,144,145) arranged such that when the spool is in a null position relative to the body, the first lobe (e.g., 143) will cover the first return opening (e.g., 139), the second lobe (e.g., 144) will cover the first and second supply openings (e.g., 140,141), and the third lobe (e.g., 145) will cover the second return opening (e.g., 142). The spool is movable off this null position in either axial direction to communicate a first space between the first and second lobes with one of the first return and supply openings(e. g.,139,140) and to communicate a second space between the second and third lobes with the opposite one of the second supply and return openings (e.g.,141,142). A driver (e.g.,122) is operatively arranged to move the spool to a desired position relative to the body. A first passageway (e.g., 132 or 163) continuously communicates one of the first supply and return openings with the first space at all operative positions between the spool and body. This first passageway has a first check valve (e.g., 133 or 164) operatively associated therewith to permit only unidirectional fluid flow through the first passageway. A second passageway (e.g., 134 or 165) continuously communicates the like one of the second supply and return openings with the second space at all operative positions between the spool and body. This second passageway also has a second check vale (e.g., 135 or 166) operatively associated therewith to permit only unidirectional fluid flow through the second passageway. When the spool is moved to an off-null position, if the pressure in one of the spaces is greater than the pressure in the other of the spaces, fluid may flow from such other space to return, but if the pressure in such other space is greater than the pressure in such one space, fluid may flow from such other space to such one space.

In another aspect, as shown in FIG. 4, the invention provides an improved valve (e.g., 172) which is adapted to be associated with a source of pressurized fluid. The improved valve includes a body (e.g., 173,174) provided with a bore (e.g., 189). The body has first and second supply openings (e.g., sleeve slots 192, 193), first and second bypass openings (e.g., sleeve slots 191,194), and first and second return openings (e.g., 190,195). Each of the supply openings communicates with the fluid source.

The valve also includes a valve spool (e.g., 175) mounted in the bore (e.g., 189) for longitudinal sliding movement relative thereto. The spool has first, second, third, fourth and fifth lobes (e.g., 196,198,199,200,201). These lobes are arranged such that when the valve is in a null position relative to the body, the first lobe (e.g.,196) will cover the first return opening (e.g., 190), the second lobe (e.g., 198) will cover the first bypass opening (e.g., 191), the third lobe (e.g., 199) will cover the first and second supply openings (e.g., 192,193), the fourth lobe (e.g., 200) will cover the second bypass opening (e.g., 194), and the fifth lobe (e.g., 201) will cover the second return opening (e.g., 195). The spool has a first annular space betwen the first and second lobes, a second annular space between the second and third lobes, a third annular space between the third and fourth lobes, and a fourth annular space between the fourth and fifth lobes. The spool is movable off-null position in either direction to selectively communicate one of the first and fourth spaces with an uncovered one of the return openings, to communicate one of the second and third spaces with an uncovered one of the supply openings, and to communicate the other of the second and third spaces with an uncovered one of the bypass openings. A driver (e.g., 176) is operatively arranged to move the spool to a desired position relative to the body. A first passageway (e.g., 212,209,211) continuously communicates the first bypass opening (e.g., 191) with the third and fourth spaces at all operative positions between the spool and body. This first passageway has a check valve (e.g.,213) operatively arranged to permit flow between the third and fourth spaces, but to prevent flow from the first bypass opening. A second passageway (e.g., 214,208,210) continuously communicates the second bypass opening (e.g., 194) with the first and second spaces at all operative positions between the spool and body. The second passageway has a check valve (e.g., 215) operatively arranged to permit flow between the first and second spaces but to prevent flow from the second bypass opening. If the pressure in one of the second and third spaces exceeds the supply pressure when the spool is off-null, fluid may flow from one of the second and third spaces to the other of the second and third spaces through one of the first and second passageways.

In any of these embodiments, an optional throttling valve may be used to cut off a flow a return and/or a flow from supply, when the load is "aiding". Moreover, such throttling valve may perform the function of check valves.

In still another aspect, as shown in FIGS. 8–11, the invention broadly provides an improved servomechanism which is adapted to be associated with a fluid source and a fluid return. Such improved servomechanism includes a fluid-powered actuator (e.g., 123, 178 or 308) having opposing first and second chambers (e.g., 149, 150,204,205 or 313,314); an electrohydraulic servovalve (e.g., 119, 172A or 309) operatively arranged to control the flow of fluid with respect to the two actuator chambers; and a throttling valve (e.g., 216A, 216B, 216C or 310) operatively arranged between the source and return and the servovalve. When an external load opposes the desired direction of actuator movement, the servovalve may be selectively operated so as to communicate the source with the higher pressure actuator chamber and to communicate the lower pressure actuator chamber with the return. However, when an external actuator load aids the desired direction of actuator movement, fluid in the higher pressure actuator chamber will be constrained to flow through the servovalve to the lower pressure chamber, while the flow from supply and/or to return is cut off.

Accordingly, one object of the invention is to provide an improved energyconserving servomechanism.

Another object is to provide an improved energyconserving servovalve for use in a servomechanism.

These and other objects and advantages will become apparent from the foregoing and ongoing written specification, the drawing, and the appended claims.

BRIEF DESCRIPTION OF THE DRAWINGS

FIG. 3*a* is a schematic view of a first form of an improved electrohydraulic servovalve for use in controlling an actuator rod, this view showing the bypass conduits as communicating the sleeve supply slots with the spaces between the spool lobes.

FIG. 3*b* is a block diagram of the improved valve shown in FIG. 3*a*.

FIG. 3*c* is a modified form of the improved valve shown in FIG. 3*a*, this view showing the bypass conduits as being provided between the sleeve return slots and the spaces between the spool lobes.

DESCRIPTION OF THE PREFERRED EMBODIMENTS

Figure 1A:
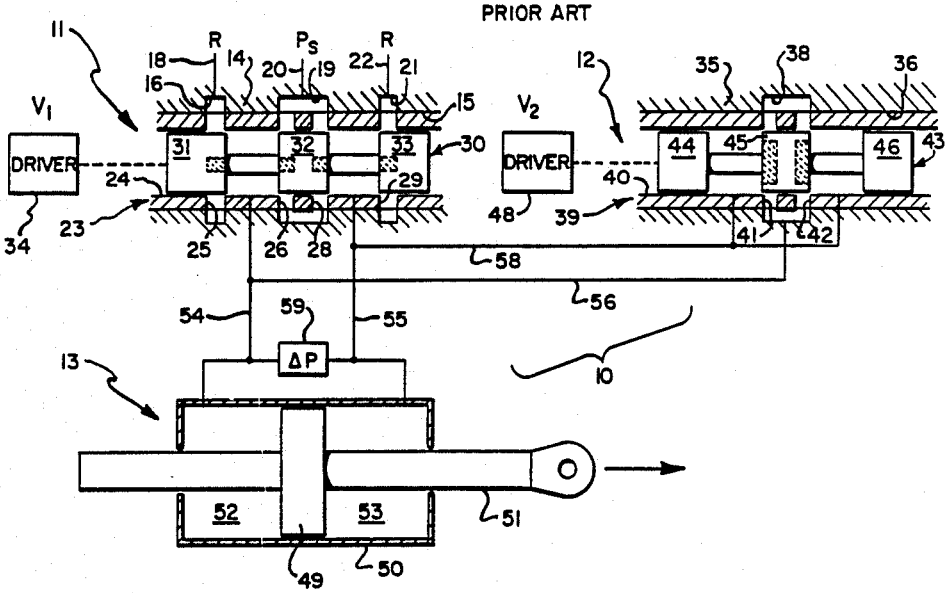
Fig. 1a. PRIOR ART
FIG. 1*a* is a schematic view of a prior art energy-conserving servomechanism which had a four-way valve and a two-way valve operating on a mutually-exclusive basis.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, etc.) together with the specification, and are to be considered a portion of the entire "written description" of this invention, as required by 35 U.S.C. §112. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" refer to the orientation of a surface relative to its axis of elongation.

Figure 1B:
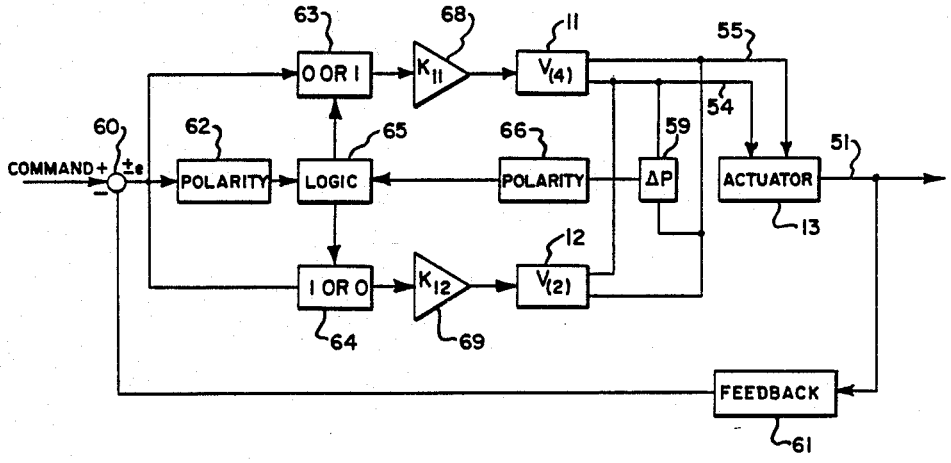
Fig. 1b. PRIOR ART
FIG. 1*b* is a block diagram of the servomechanism shown in FIG. 1*a*.
Figure 4:
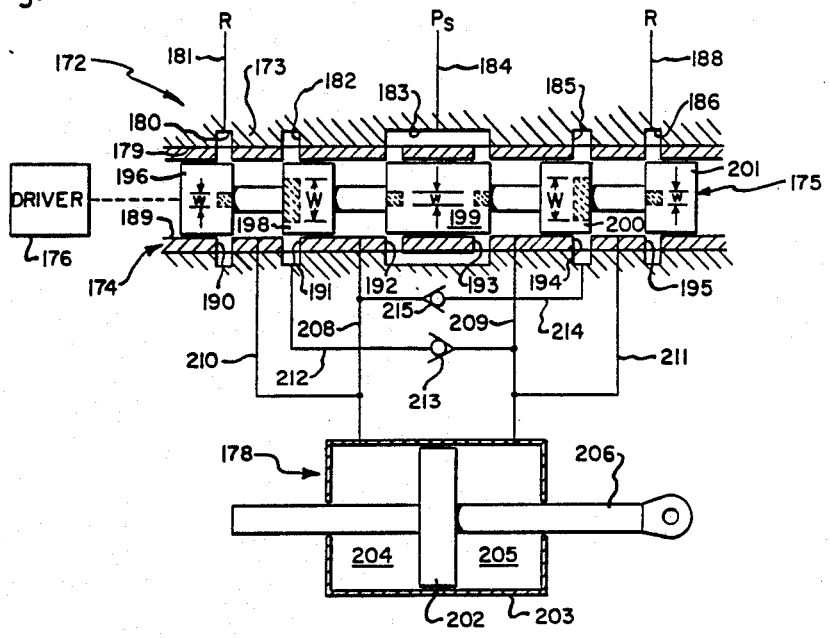
FIG. 4 is a schematic view of another form of an improved valve, which may be operatively employed to control the position of an actuator rod when either an "aiding" or "opposing" load is applied thereto.
Figure 5:
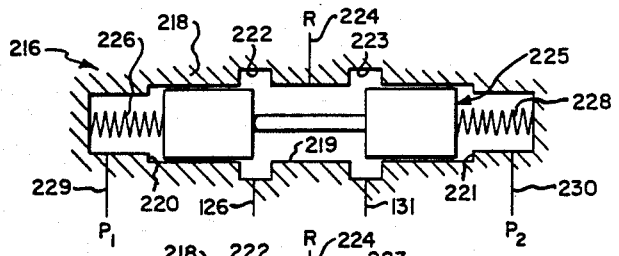
FIG. 5 is a schematic view of a spring-centered throttling valve, which may be used in association with the improved valve shown in FIG. 3*a*, this view showing the throttling valve spool in a centered position relative to its body.
Figure 6:
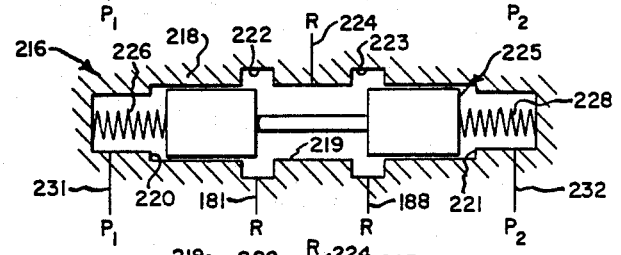
FIG. 6 is a schematic view of the throttling valve shown in FIG. 5, but showing how this valve may be associated with the improved valve shown in FIG. 4 to cut off the flow to return.
Figure 7:
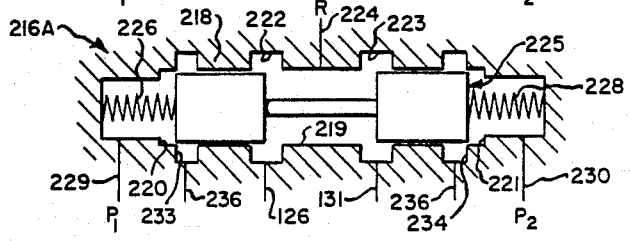
FIG. 7 is a schematic view of a modified throttling valve which incorporates check valve functions.
Figure 9:
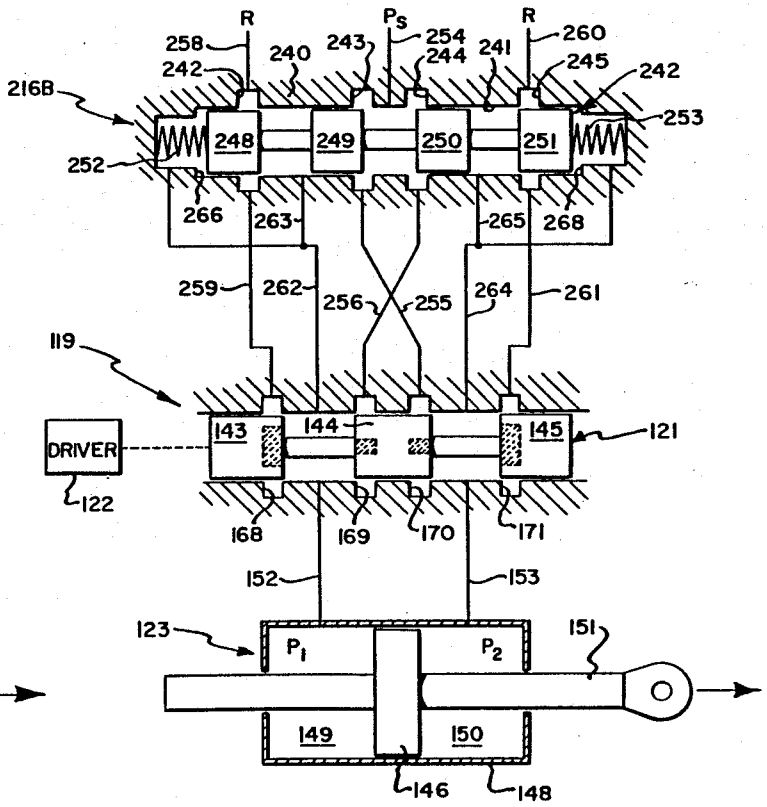
FIG. 9 is a schematic view of a further modified throttling valve in association with the servovalve and actuator shown in FIG. 3*c*, to cut off the flow from supply in the case of an "aiding" load.
Figure 8:
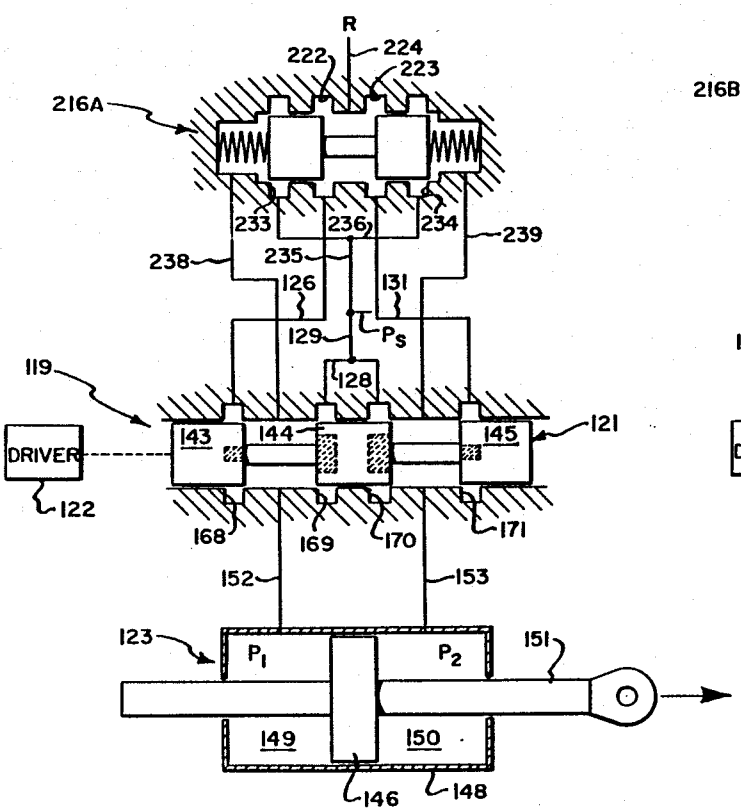
FIG. 8 is a schematic view of the modified throttling valve shown in FIG. 7, in associated with the servovalve and actuator shown in FIG. 3*a*, to cut off the flow to return in the case of an "aiding" load.
Figure 10:
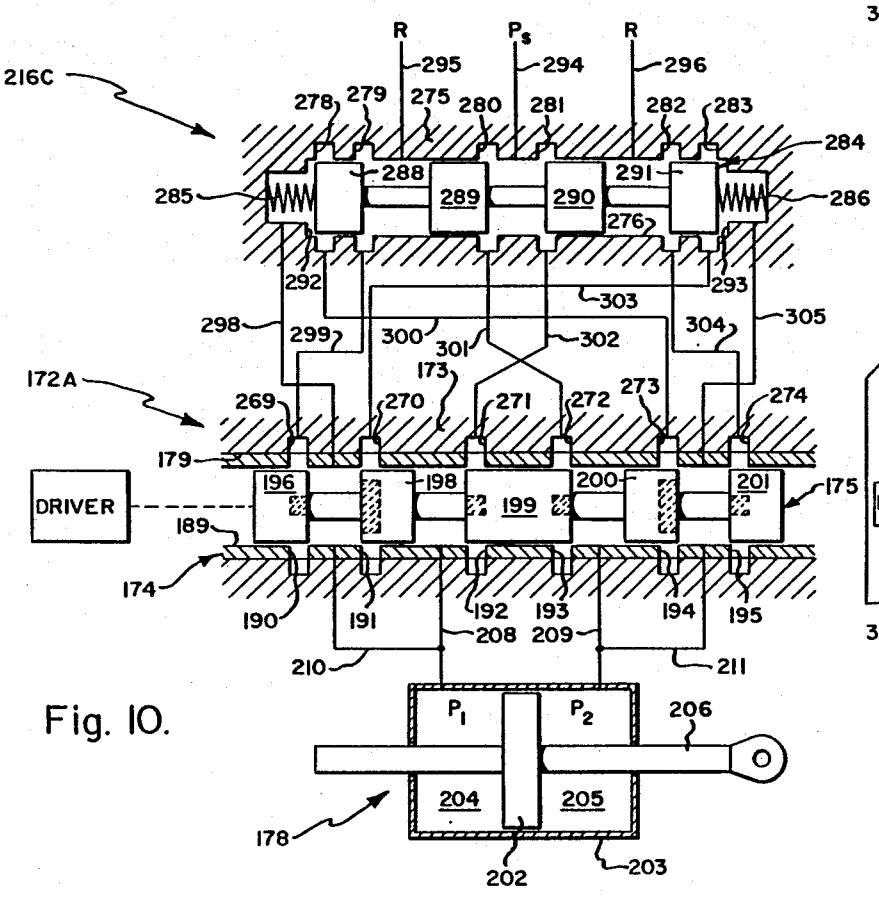
FIG. 10 is a schematic view of a modified form of the servovalve shown in FIG. 4 in association with a further modified throttling valve, which functions to completely cut off fluid flow from the supply and to the return in the case of an "aiding" load.

Referring now to the drawings, this invention broadly provides an improved energy-conserving servovalve and an improved energy-conserving valve arrangement for use in a servomechanism. FIGS. 1*a* and 1*b* show a servomechanism, which is presently believed to be within the penumbra of the prior art, and which had a four-way valve and a two-way valve operating on a mutually-exclusive basis. The four-way valve provided active control of the actuator when the load was "opposing", but became inactive if the load was "aiding". Conversely, the two-way valve provided active control if the load was "aiding", but became inactive if the load was "opposing". FIGS. 2*a*–2*d* relate to a first embodiment of an improved servoactuator, and various modifications thereof. FIGS. 3*a*–3*c* relate to a second embodiment of an improved valve, and various modifications thereof, for use in a servomechanism. FIG. 4 relates to a third embodiment of an improved valve for use in a servomechanism. FIGS. 5–7 show various forms of throttling valves. FIGS. 8 and 9 show such throttling valves in assocation with the servovalve embodiments depicted in FIG. 3*a* and 3*c*. FIG. 10 shows a modified version of the valve shown in FIG. 4 in association with a further modified throttling valve. The prior art implementation and the various improved embodiments will be described seriatim herebelow.

Prior Art Servomechanism (FIGS. 1*a* and 1*b*)

FIG. 1*a* shows a form of an energy-conserving servomechanism, generally indicated at 10, which is presently believed to either be individually "old" or "obvious" over the prior art. This servomechanism broadly included a four-way electrohydraulic servovalve 11, a two-way electrohydraulic servovalve 12, and a double-acting fluid-powered actuator 13.

Valve 11 had a body 14 provided with a horizontally-elongated bore 15. Three axially-spaced annular grooves extended radially into the body from bore surface 15. The leftward groove 16 communicated with a fluid return, such as a sump (not shown), at a return pressure R via a conduit 18, the middle groove 19 communicated with a source (not shown) of pressurized fluid at a supply pressure $P_s$ via a conduit 20, and the rightward groove 21 communicated with the return via a conduit 22.

A tubular sleeve 23 was mounted fast within the body bore, and had an inwardly-facing cylindrical surface or bore 24. This sleeve was provided with four circumferentially-spaced-radial through-slots at each of four axially-spaced locations therealong. The first slots, one of which is indicated at 25, were aligned with body groove 16; the second slots, one of which is indicated at 26, registered with body groove 19; the third slots, one of which is indicated at 28, also registered with body groove 19; and the fourth slots, one of which is indicated at 29, were aligned with body groove 21. While only those slots which are arranged at the 6:00 o'clock positions have been numbered in FIG. 1*a*, it will be understood that the other slots of each circumferentially-spaced group were located at the 9:00 o'clock positions (not shown), at the 12:00 o'clock positions, and at the 3:00 o'clock positions (which are seen in phantom elevation and cross-hatched for clarity). It should also be understood that the body and sleeve were formed separately only for manufacturing convenience, and were subsequently assembled together. Hence, the sleeve should be regarded as integral with the body.

The valve also had a three-lobed valve spool 30 mounted within the sleeve for horizontal sliding movement therealong. When the spool was in a null position relative to the body (as shown in FIG. 1*a*), the spool left lobe 31 was arranged to cover the sleeve left return slots 25, the spool middle lobe 32 was arranged to cover the sleeve left and right supply slots 26,28, and the spool right lobe 33 was arranged to cover the sleeve right return slots 29. An electro-mechanical driver, indicated at 34, was arranged to selectively displace the spool either leftwardly or rightwardly, as desired, from the null position to a desired position relative to the body. The magnitude of such spool displacement was proportional to the magnitude of the error signal supplied to driver 34, while the direction of spool movement was governed by the polarity of the error signal. As the spool began to move relative to the sleeve from such null position, the partially-uncovered sleeve slots would form ports or orifices through which fluid could pass. Thus, if the spool was displaced leftwardly off null, the space between lobes 31,32 would communicate with left return slots 25 through the uncovered left return ports, while the space between lobes 32,33 would communicate with right supply slots 28 through the uncovered right supply ports. On the other hand, if the spool was displaced rightwardly off null, the space between lobes 31,32 would communicate with left supply slots 26 through the uncovered left supply ports, while the space between lobes 32,33 would communicate with right return slots 29 through the uncovered right return ports. These various sleeve supply and return ports were all identical in exposed area, at any operative position of the spool relative to the sleeve, and therefore had the same gain. Hence, the size of the orifices defined by these supply and return ports was simply proportional to the magnitude of the spool displacement from the null position. Because of this, the pressure drops across the supply and return ports were the same at any displaced spool position.

The two-way servovalve 12 also had a body 35 provided with a horizontally-elongated bore 36. An annular groove 38 extended radially into the body from bore surface 36. A tubular sleeve 39 was mounted fast within the body bore, and had an inwardly-facing cylindrical surface 40. This sleeve was provided with four circumferentially-spaced radial through-slots at each of two axially-spaced locations therealong. The leftward sleeve slots, one of which is indicated at 41, as well as the rightward sleeve slots, one of which is indicated at 42, were both aligned with body groove 38. While only those slots which are arranged in the 6:00 o'clock positions have been numbered in FIG. 1*a*, it will be understood that the other slots of each circumferentially-spaced group were located at the 9:00 o'clock positions (not shown), at the 12:00 o'clock positions, and the 3:00 o'clock positions (which are seen in phantom elevation and cross-hatched for clarity). Here again, the body and sleeve were formed separately only for manufacturing convenience, and were subsequently assembled together.

Servovalve 12 also had a three-lobed valve spool 43 mounted within sleeve 39 for longitudinal sliding movement therealong. The spool had left, middle and right lobes, 44,45,46, respectively. An electro-mechanical driver, generally indicated at 48, was arranged to selectively displace spool 43 either leftwardly or rightwardly, as desired, from the illustrated null position to a desired position relative to the body. If spool 43 was in a null position relative to the body (as shown in FIG. 1*a*), the spool middle lobe 45 was arranged to cover each of sleeve left and right slots 41,42. However, when the spool began to move relative to the sleeve from such null position, the partially uncovered slots would form ports or orifices through which fluid could pass. Thus, if the spool was displaced leftwardly off null, right sleeve slots 42 would communicate with the space between lobes 45,46. Alternatively, if the spool was displaced rightwardly off null, left sleeve 41 would communicate with the space between lobes 44,45. These various sleeve slots 41,42 were identically configured, and the size of the ports or orifices defined by the partially-uncovered slots was again simply proportional to the magnitude of such spool displacement from the null position, which, in turn, was proportional to the magnitude of the error signal supplied to driver 48. The direction of spool movement was again dictated by the polarity of the error signal.

The actuator 13 was a conventional double-acting fluid-powered actuator and had a piston 49 slidably mounted within a cylinder 50. A rod 51 was fixed to the piston and sealingly penetrated both ends of the cylinder. The piston subdivided the cylinder into a left chamber 52 and a right chamber 53.

A conduit 54 communicated the space between first valve lobes 31,32 with actuator left chamber 52, while a conduit 55 communicated the space between first valve lobes 32,33 with actuator right chamber 53. Conduit 56 communicated conduit 54 with second valve body groove 38, and conduit 58 communicated conduit 55 with the spaces between second valve lobes 44,45 and 45,46. The pressure differential between conduits 54 and 55 was sensed by a pressure sensor 59.

FIG. 1*b* is a block diagram of the servomechanism schematically shown in FIG. 1*a*. An electrical command signal, reflective of the desired position of actuator rod 51, was supplied to a summing point 60, which also received a negative feedback signal from a feedback transducer 61, reflective of the actual position of the actuator rod. The algebraic sum of the command and feedback signals was supplied as an error signal ($\pm e$) to a polarity sensor 62, to a multiplier 63, and to a multiplier 64. Sensor 62 supplied the polarity of the error signal to a logic unit 65, which also received from polarity sensor 66, the polarity of the differential pressure in conduits 54,55, as sensed by pressure sensor 59. By comparing the polarities of the signals supplied by polarity sensors 62,66, the logic unit could determine whether the load exerted on actuator rod 51 was "opposing" or "aiding" with respect to the direction of desired rod movement. For example, if it was desired to move actuator rod 51 rightwardly, polarity sensor 62 would determine the polarity of the error signal and supply such information to the logic unit. If, at the same time, the force exerted on the actuator rod was opposite to such desired direction of rod movement, an "opposing" load was sensed by the pressure in conduit 54 being greater than the pressure in conduit 55. On the other hand, if the force exerted on the actuator rod was in the same direction as the desired direction of rod movement, an "aiding" load was sensed by the pressure in conduit 55 being greater than the pressure in conduit 54. The polarity of the sensed pressure differential was supplied to the logic unit by polarity sensor 66. Thus, logic unit 65 could determine whether the load was "opposing" or "aiding".

If the load was "opposing", logic unit 65 would cause multiplier 63 to produce a multiplicand of "1", and would cause multiplier 64 to produce a multiplicand of "0". The product of the error signal ($\pm e$), the unit multiplicand (1) provided by multiplier 63, and the gain ($K_{11}$) of servoamplifier 68, was supplied to the driver of valve 11, which displaced the spool relative to the body and caused the actuator rod 51 to move in the appropriate direction until the error signal was reduced to zero. At the same time, logic unit 65 would cause multiplier 64 to produce a "0" multiplicand. The product of the error signal (±e), the zero multiplicand (0) provided by multiplier 64, and the gain ($K_{12}$) of servoamplifier 69, was zero. Hence, the spool of valve 12 would return to its null position, blocking communication between conduts 56,58. Thus, when an "opposing" load was sensed, active flow control to and from the actuator was provided by four-way valve 11, while two-way valve 12 was returned to null and therefore rendered inactive.

On the other hand, if the logic unit sensed that the load was "aiding", it caused multiplier 63 to produce a multiplicant of "0", while multiplier 64 was caused to provide a multiplicant of "1". Since the product of the error signal (±e), the zero multiplicand (0) produced by multiplier 63, and the gain ($K_{11}$) of servoamplifier 68, was zero, valve 11 would return to its null position. However, the product of the error signal (±e), the unit multiplicand (1) provided by multiplier 64, and the gain ($K_{12}$) of servoamplifier 69, was some positive or negative value, and valve 12 would operate to control fluid flow to and from the expanding and contracting chambers of the actuator. Thus, if an "aiding" load was sensed, active flow control from and to the actuator was provided by two-way valve 12, while four-way valve 11 was returned to null and therefore rendered inactive. In this regard, it should be noted that in the case of an "aiding" load, fluid from the higher pressure actuator chamber flowed through the two-way valve to the lower pressure actuator chamber.

The significance of the foregoing is that while the combination of a four-way servovalve and a two-way servovalve did provide operable control over the actuator rod, the four-way valve provided flow control only when the load was "opposing", and the two-way valve became active only when the load was "aiding". In effect, the operation of the two valves was mutually-exclusive.

First Embodiment (FIGS. 2*a*–2*d*)

Figure 2A:
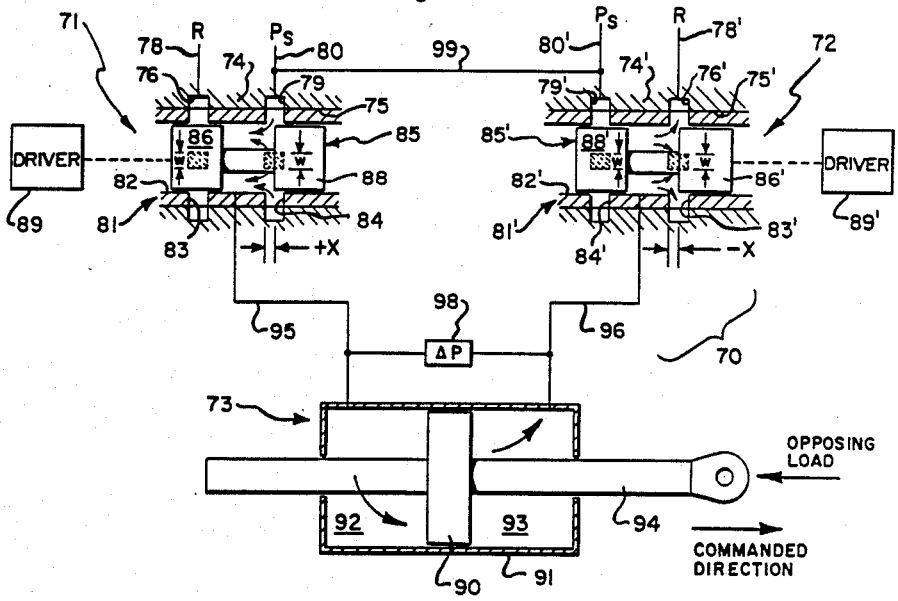
FIG. 2*a* is a schematic view of an improved servomechanism having two three-way electrohydraulic servovalves operable in continuous cooperation with one another to control the displacement of an actuator rod, and showing the displaced condition of the valve spools when it is desired to move an "opposing" load.

Referring now to FIG. 2*a*, an improved servomechanism, generally indicated at 70, is shown as broadly including a leftward first valve 71, a rightward second valve 72, and a conventional double-acting fluid-powered actuator 73.

Each of valves 71,72 is a three-way electrohydraulic servovalve. Since these two valves are structurally identical to one another, albeit the second valve is arranged as a mirror image of the first, only the first valve will be specifically described. However, the corresponding parts, portions or surfaces of the second valve are indicated by the prime of the same reference numeral used to describe such parts, portions or surfaces with respect to the first valve.

Valve 71 has a body 74 provided with a horizontally-elongated bore 75. Two axially-spaced annular grooves extend radially into the body from bore surface 75. The leftward groove 76 communicates with a fluid return (not shown) at a return pressure R via a conduit 78. The rightward groove 79 communicates with a source (not shown) of pressurized fluid at a supply pressure $P_s$ via conduit 80.

A tubular sleeve 81 is mounted fast within the body bore, and has an inwardly-facing cylindrical surface or bore 82. This sleeve is provided with four circumferentially-spaced radial through-slots at each of two axially-spaced locations therealong. The leftward first slots, one of which is indicated at 83, are aligned with leftward body groove 76, while the rightward second slots, one of which is indicated at 84, are aligned with the rightward body groove 79. While only those slots which are arranged in the 6:00 o'clock positions have been numbered, it will be understood that the other slots of each circumferentially-spaced group are arranged at the 9:00 o'clock positions (not shown), at the 12:00 o'clock positions, and at the 3:00 o'clock positions (which are again seen in phantom elevation and cross-hatched for clarity). Here again, the body and sleeve are formed separately only for manufacturing convenience and are subsequently assembled together. Hence, for all practical purposes, the sleeve should be regarded as a part of the body.

Valve 71 also has a two-lobed valve spool 85 mounted in the sleeve for horizontal sliding movement therealong. When the spool is in a null position (not shown) relative to the sleeve, the spool left lobe 86 is arranged to cover left return slots 83, and the spool right lobe 88 is arranged to cover right supply slots 84. However, in FIG. 2*a*, spool 85 is shown as having been displaced rightwardly from such null position by a distance of +x so as to continue to cover return slots 83 while partially uncovering supply slots 84. These uncovered supply slots form ports or orifices through which fluid may flow from supply conduit 80 to the annular space between spool lobes 86,88. Alternatively, if the spool were to be displaced leftwardly from such null position (not shown), spool lobe 88 would continue to cover right supply slots 84, while the left return slots 83 would be partially uncovered. These partially-uncovered return slots would form ports or orifices through which fluid could flow from the space between spool lobes 86,88 to return conduit 78.

An electro-mechanical driver, indicated at 89, is operatively arranged to selectively displace spool 85 either leftwardly or rightwardly to a desired position relative to the associated sleeve. Because the circumferential widths (w) of slots 83, 84 are the same, the sizes of the ports or orifices defined by the partially-uncovered slots are proportional to the magnitude of such spool displacement, which, in turn, is proportional to the magnitude of the error signal supplied to driver 89. In other words, all ports have the same gain. The direction of spool displacement is governed by the polarity of the error signal.

As previously indicated, the second valve 72 is structurally identical to the first valve, but is arranged as a mirror image of same. However, whereas the first valve spool is shown as having been displaced rightwardly from its null position by a distance of +x so as to partially uncover the first valve supply slots 84, the second valve spool 85′ is shown as having been displaced rightwardly from its null position by a distance of −x so as to partially uncover return slots 83′. These partially-uncovered return slots form ports or orifices through which fluid may flow from the space between right spool lobes 86′,88′ and right return conduit 78′. Moreover, because the various sleeve slots in each valve have the same circumferential width (w) as the corresponding slots of the first valve, and because both spools have been displaced from their null positions by the same axial distance (i.e.,±x), the cross-sectional area of the first valve supply ports is substantially equal to the cross-sectinal area of the second valve return ports. In other words, the ports of the second valve have the same gain as the ports of the first valve. This would also hold if the first valve 71 were to be displaced leftwardly from its null position by a distance of −x, and the second valve 72 were to be similarly displaced leftwardly from its null position by a distance of +x, as shown in FIG. 2*d*. The significance of this is that, for like displacements of the spools, the pressure drops across the supply and return ports will be substantially the same at all operative positions of the spools relative to their associated sleeves.

The actuator 73 is again shown as having a piston 90 slidably mounted within a cylinder 91. This piston subdivides the cylinder into a leftward chamber 92, and a rightward chamber 93. A rod 94 is mounted fast to the piston and penetrates both ends of the cylinder.

A conduit 95 continuously communicates the space between first valve lobes 86, 88 with actuator left chamber 92, and another conduit 96 continuously communicates the space between second valve lobes 86',88' with the actuator right chamber 93. A pressure sensor 98 is operatively arranged to sense the differential pressure in conduits 95,96.

Still another conduit continously communicates one of the supply and return slots of the first valve with the like one of the supply and return slots of the second valve. In the specific embodiment shown in FIGS. 2*a* and 2*b*, this conduit is indicated at 99, and is shown as communicating the supply conduits 80,80' of the respective valves. In the modified embodiment shown in FIG. 2*d*, this conduit is indicated at 110, and communicates the return conduits 78,78' of the two valves.

Figure 2B:
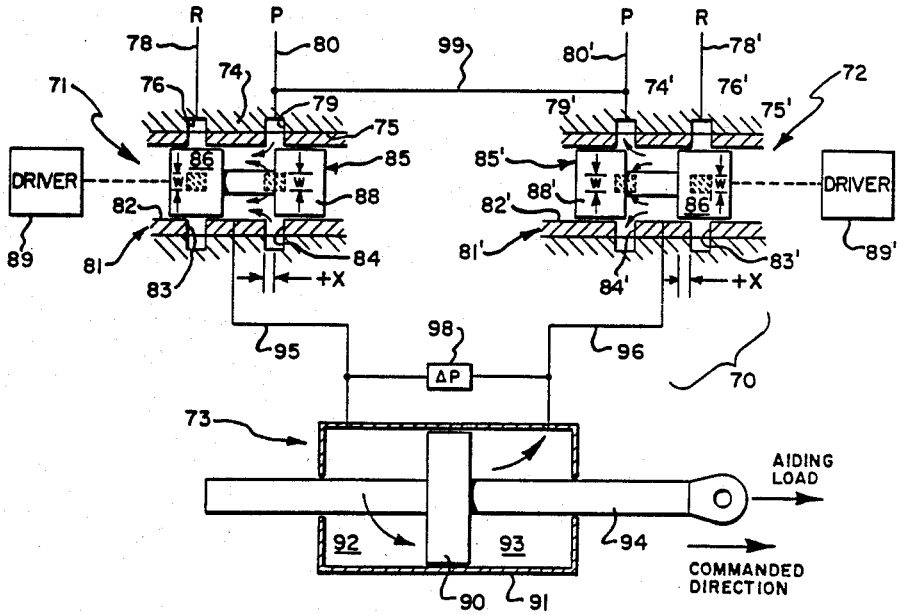
FIG. 2*b* is a schematic view of the improved servomechanism shown in FIG. 2*a*, but showing the displaced condition of the valve spools when it is desired to move the actuator rod in the same direction as an "aiding" load.
Figure 2C:
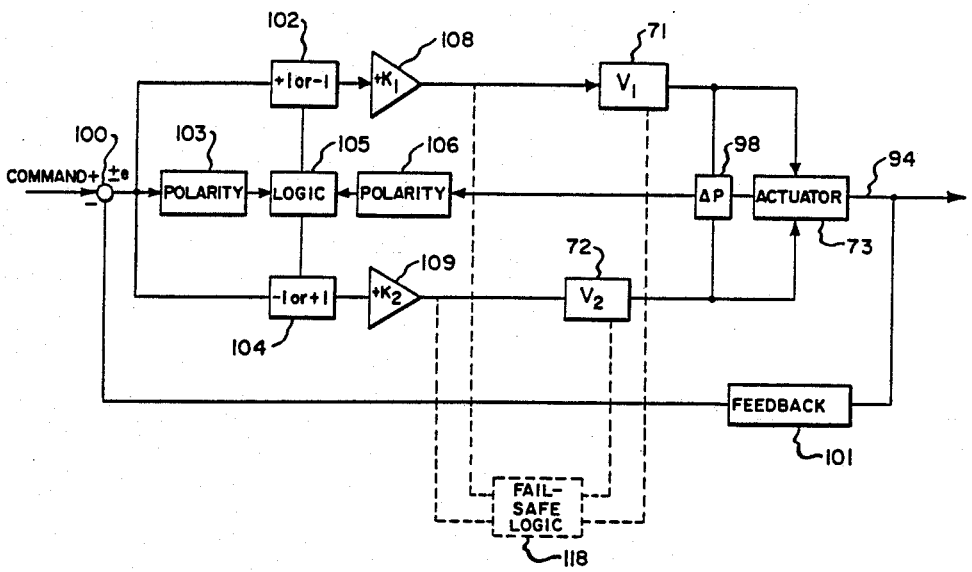
FIG. 2*c* is a block diagram of the servomechansim shown in FIGS. 2*a* and 2*b*.
Figure 2D:
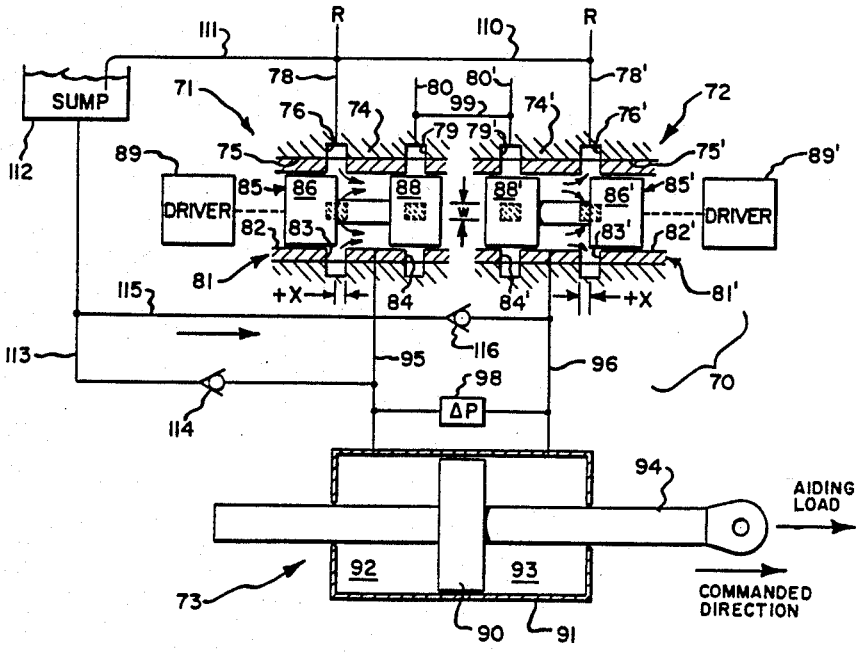
FIG. 2*d* is a schematic view of a modified form of the servomechanism shown in FIGS. 2*a* and 2*b*, wherein the opposing actuator chambers communicate through the common fluid return.

FIG. 2*c* is a block diagram of the valve shown in FIGS. 2*a* and 2*b*. An electrical command signal, reflective of the desired position of the actuator rod, is supplied to a summing point 100, which also receives a negative feedback signal, reflective of the actual position of the rod, from a feedback transducer 101. The algebraic sum of the command and feedback signals is supplied as an error signal (±e) to a multiplier 102, to a polarity sensor 103, and to a multiplier 104. The polarity of the error signal is supplied by polarity sensor 103 to a logic unit 105. The polarity of the load pressure differential between conduits 95,96 is determined by a polarity sensor 106, and this signal is also supplied to the logic unit. The logic unit compares the polarities of the signals supplied by sensors 103,106, and causes one multiplier to produce a multiplicand of either +1 or −1, and causes the other multiplier to produce a multiplicand of −1 or +1, as appropriate. The polarity of the signal supplied by polarity sensor 103, indicates the desired direction of rod movement.

If the load is "opposing", the logic unit causes the appropriate one of the multipliers to produce a +1 multiplicand, and causes the other of the multipliers to produce a −1 multiplicand. The desired direction of actuator movement, and the direction of the "opposing" load, will determine which of the multipliers is caused to generate the positive multiplicand and which is caused to generate the negative multiplicand. In any event, the product of the error signal (±e), the multiplicand (+1 or −1) provided by multiplier 102, and the gain ($K_1$) of the first valve servoamplifier 108, is supplied to the first valve driver, which displaces the first spool in the appropriate direction by a proportional distance to uncover one of the first valve supply and return slots. At the same time, the product of the error signal (±e), the multiplicand (−1 or +1) provided by multiplier 104, and the gain ($K_2$) of the second valve servoamplifier 109, is supplied to the second valve driver, which displaces the second spool in the opposite direction by the same proportional distance to uncover the opposite one of the second valve supply and return slots. Since the various supply and return slots of both servovalves are of the same circumferential width, the gains of the two valves are identical. Because the same error signal (±e) is supplied to both multipliers, the displacements of the first and second spools will be substantially the same for both "aiding" and "opposing" loads. However, if the load is "opposing", the signs of the unit multiplicands respectively provided by multipliers 102,104 will be such that one of the spools will be moved off null by a distance of +x, while the other spool will be moved off null by the same distance of −x. This is shown in FIG. 2a.

On the other hand, if the logic unit determines that the load is "aiding", it will cause both multipliers to produce multiplicands of the same polarity (i.e., either +1 or −1, as appropriate) such that both spools will be displaced off null by the same distance in the same direction (i.e., either +x and +x, or −x and −x). The effect of this is to cause the first valve spool to uncover one of its supply and return slots, and to cause the second valve spool to uncover the like one of its supply and return slots, as shown in FIG. 2*b*. In the embodiment shown in FIGS. 2*a* and 2*b*, the two supply slots 84,84' are in continuous communication through conduit 99. Thus, if both supply slots are uncovered when an "aiding" load is sensed, as shown in FIG. 2*b*, the expanding actuator chamber will effectively be at supply pressure and the contracting actuator chamber will be at some pressure greater than supply pressure. Hence, fluid may flow from the higher pressure right actuator chamber 93 through conduit 96, the second valve supply ports, conduit 99, the first valve supply ports, and conduit 95, and enter the lower pressure left actuator chamber 92, without drawing fresh pressurized fluid from the source. Thus, energy is conserved when an "aiding" load is applied to the actuator, by permitting fluid to flow from the higher pressure contracting actuator chamber through conduit 99 to the lower pressure expanding actuator chamber, rather than by supply fresh pressurized fluid to such expanding chamber.

FIG. 2*d* illustrates a reverse configuration in which conduit 99 has been replaced by a conduit 110, which continuously communicates the return slots 83,83' of the two valves. If desired, a further conduit 111 may communicate condiut 110 with a sump 112. Another conduit 113 may communicate the sump with conduit 95. This conduit is shown as containing a check valve 114, which permits flow from the sump to conduit 95, but prevents flow in the opposite direction. Another conduit 115 may communicate conduits 113,96, and may also include a check valve 116 to permit only unidirectional flow from the sump to conduit 96. These additional conduits 113,115, and their associated check valves, function to prevent cavitation as fluid is drawn into the expanding actuator chamber. Thus, if a rightward "aiding" load is applied to the actuator rod and both spools are displaced off null by a distance of +x so as to uncover the respective return slots, as shown in FIG. 2*d*, fluid may flow from the higher pressure contracting right actuator chamber through conduit 96, the second valve return port, right return conduit 78', conduit 110, left return 78, the first valve return port, conduit 95, and enter the expanding lower pressure left actuator chamber. In this regard, conduit 110 may simply be a common fluid return such that, as the actuator piston moves rightwardly, fluid from either the return, or the sump, or both, is drawn into the expanding actuator chamber without admitting fresh supply pressure to same.

Another feature of this first embodiment (i.e., FIGS. 2*a* and 2*b*), and its reverse configuration (i.e., FIG. 2*d*), lies in the manner by which flow control is achieved. In the prior art embodiment shown in FIGS. 1*a* and 1*b*, the two valves operated on a mutually-exclusive basis such that flow control was afforded by whichever valve was operable at the time. However, in the cooperative operation of the first embodiment (FIGS. 2*a* and 2*b*) and the modification (FIG. 2*d*) thereof, fluid is constrained to flow through one orifice provided by the first valve and through a second orifice provided by the second valve, when the load is either "opposing" or "aiding". This feature readily lends itself to application of optional fail-safe logic, such as indicated in phantom at 118 in FIG. 2*c*. This logic may compare the actual position of each valve spool with the magnitude of the signal supplied to its associated driver. A discrepancy between such compared ratios can then be used to sense a failure of one valve or the other, and to cause an appropriate signal to be supplied to disable the system before the errant valve assumes a hard-over position.

While valves 71,72 may be operated cooperatively such that their respective spools 85,85' are displaced proportionally off-null in opposite positional ranges (i.e., +x and −x, or vice versa) when the load is "opposing", but in the same positional range (i.e., +x and +x, or −x and −x) when the load is "aiding", this mode of operation may be varied. For example, when the apparatus is in the condition shown in FIG. 2*d*, the spool of left valve 71 may be returned to its null position. If this occurs, fluid may circulate from the actuator contracting chamber 93 through conduit 96, the return port of valve 72, conduits 78', 110, 111, sump 112, conduit 113, check valve 114, and conduit 95, to enter the actuator expanding chamber 92. The structure shown in FIGS. 2*a* and 2*b* could be readily modified to provide a similar mode of operation. To do this, suitable conduits (not shown) would be provided so as to communicate conduit 95 with conduit 99, and to communicate conduit 96 with conduit 99. Each of these additional conduits would incorporate a check valve arranged to permit unidirectinal flow from conduit 99 to the associated one of conduits 95,96. Thus, such modified structure could be operated such that, when an "aiding" load was applied to the actuator, whichever valve was associated with the higher-pressure actuator contracting chamber, would be returned to null while the supply port of the other valve remained open. Therefore, the valves may be operated cooperatively by having the spools be displaced by the same distance in the appropriate directions, or may be operated independently of one another. Such cooperative operation requires that the recirculating fluid flow sequentially through the like ports of both valves, whereas such independent operation requires that the recirculating fluid pass through a single port of only one valve.

Second Embodiment (FIGS. 3*a*–3*c*)

Referring now to FIG. 3*a*, an improved valve, generally indicated at 119, is shown as broadly including a body 120, a three-lobed spool 121 movable relative to the body, and a driver 122 operatively arranged to selectively displace the spool relative to the body. Valve 119 is shown as being operatively associated with a double-acting fluid-powered actuator 123.

The body 120 is shown as being provided with a horizontally-elongated bore 124. Three axially-spaced annular grooves extend radially into the body from bore surface 124. The leftward groove 125 communicates with a fluid return (not shown) at a return pressure R via a conduit 126. The middle groove 128 communicates with a source (not shown) of pressurized fluid at a supply pressure $P_s$ via a conduit 129. The rightward groove 130 communicates with the fluid return via a conduit 131. A first bypass passageway 132 is provided in the body to communicate supply conduit 129 with bore surface 124 at a position between body recesses 125,128, and contains a check valve 133 operatively arranged to permit fluid to flow from the bore to the supply conduit, but not reversely. Similarly, a second bypass passageway 134 is provided in the body to communicate the supply conduit 129 with bore surface 124 at a position between body grooves 128,130. This second bypass passageway also includes a check valve 135 which is operatively arranged to permit fluid flow from the bore to the supply conduit, but not reversely. To avoid obfuscating the improvement, bypass conduits 132, 134 have been schematically shown as being lines.

A tubular sleeve, generally indicated at 136, is mounted fast within the body bore, and has an inwardly-facing cylindrical surface or bore 138. Sleeve 136 is shown as having four circumferentially-spaced radial through-slots arranged at each of four axially-spaced locations therealong. The leftward first slots, one of which is indicated at 139, are aligned with left body groove 125. The next-rightward second slots, one of which is indicated at 140, register with middle body groove 128, the next-rightward third slots, one of which is indicated at 141, also communicate with the middle body groove 128. The rightward fourth slots, one of which is indicated at 142, are aligned with right body groove 130. While only those slots which are arranged in the 6:00 o'clock positions have been numbered, it will be appreciated that the other slots of each circumferentially-spaced group are arranged at the 9:00 o'clock positions (not shown) at the 12:00 o'clock positions, and at the 3:00 o'clock positions (which are seen in phantom elevation and cross-hatched for clarity). Here again, the body and sleeve are formed separately only for manufacturing convenience, but are subsequently assembled together. Hence, the sleeve should, for practical purposes, be regarded as a part of the body.

The axial length of each of slots 139,140,141,142 is substantially the same. Each of return slots 139,142 is of substantially equal circumferential width($w_r$). Similarly, each of supply slots 140,141 of substantially equal circumferential width ($w_p$). However, the supply slots 140,141 are shown as occupying substantially greater arcuate distances than return slots 139,142. Hence, the gain of the supply slots is substantially greater than the gain of the return slots. Indeed, each of supply slots 140,141 may have a circumferential width on the order of four times the circumferential width of return slots 139,142. Thus, if each of return slots 139,142 occupies an included angle of, say, 15 degrees, then each of supply slots 140, 141 may occupy an included angle of about, say, 60 degrees. The exact ratio between the circumferential widths of these supply and return slots is not deemed critical, and may be readily varied. However, it is presently preferred that the circumferential width ($w_p$) occupied by the supply slots be substantially greater than the circumferential width ($w_r$) occupied by the return slots (as shown in FIG. 3*a*), or vice versa (as shown in FIG. 3*c*). These circumferential slot widths determine the gain of the valve per unit of spool displacement off-null. The sleeve is shown as further including a first passageway which communicates the body first bypass passageway 132 with sleeve bore 138, and a second passageway which communicates the body second passageway 134 with the sleeve bore 138.

Valve spool 121 is mounted within the sleeve for longitudinal sliding movement along bore 138. When the spool is in a null position relative to the sleeve (as shown in FIG. 3*a*), the spool left lobe 143 covers left return slots 139, the spool middle lobe 144 covers each of the left and right supply slots 140,141, and the spool right lobe 145 covers right return slots 142. The drivr 122, is operatively arranged to move the spool either leftwardly or rightwardly, as desired, to a selected position relative to the body. If the spool moves rightwardly from the null position shown in FIG. 3*a*, the left lobe 143 will continue to cover left return slots 139, the middle lobe 144 will partially uncover left supply slots 140, thereby forming left supply ports or orifices which communicate the supply conduit 129 with the annular space between the spool left and middle lobes, but will continue to cover right supply slots 141; and the right lobe 145 will partially uncover right return slots 142, thereby forming right return ports or orifices which communicate the annular space between the spool middle and right lobes with return conduit 131. On the other hand, if the spool is moved leftwardly from the illustrated null position, the spool left lobe 143 will partially uncover left return slots 139, thereby forming left return ports or orifices which communicate the annular space between the spool left and right lobes with return conduit 126; the spool middle lobe 144 will continue to cover left supply slots 140 but will partially uncover right supply slots 141, thereby forming right supply ports or orifices which communicate supply conduit 129 with the space between the spool middle and right lobes; and the spool right lobe 145 will continue to cover right return slots 142. Thus, depending on whether the spool is moved leftwardly or rightwardly from such null position, one of the return slots will be partially uncovered and one of the supply slots will be partially uncovered. However, because of the different circumferential widths occupied by the respective supply and return slots, the cross-sectional area (i.e.,gain) of the uncovered supply ports per unit of spool displacement, will be substantially greater than the cross-sectional area of the uncovered return ports.

The actuator 123 is shown as having a piston 146 slidably mounted within a cylinder 148, and as separating the cylinder into a leftward first chamber 149 and a rightward second chamber 150. A rod 151 is fixed to the piston and sealingly penetrates both ends of the cylinder. A first conduit 152 continuously communicates the annular space between the spool left and middle lobes with the actuator left chamber 149, and a second conduit 153 continuously communicates the annular space between the spool middle and right lobes with the actuator right chamber 150. A pressure sensor 154 is operatively arranged to sense both the polarity and the magnitude of the differential load pressure between conduits 152,153.

FIG. 3*b* is a block diagram of the valve shown in FIG. 3*a*. An electrical command signal, reflective of the desired position of actuator rod 151, is supplied to a summing point 155, which also receives a negative feedback signal, reflective of the actual position of the actuator rod, from a feedback transducer 156. The algebraic sum of the command and feedback signals is supplied as an error signal ($\pm e$) to a multiplier 158 and to a polarity sensor 159, which, in turn, supplies the polarity of the error signal to a logic unit 160. Pressure sensor 154 is arranged to sense the magnitude and polarity of the pressure differential in conduits 152,153, and supplies the magnitude and polarity of such sensed differential to the logic unit. The polarity of such sensed pressure differential is determined by a polarity sensor 161, which supplies such sensed polarity to the logic uni. The logic unit compares the signals produced by polarity sensors 159,161, determines whether the load applied to the actuator rod is "opposing" or "aiding" with respect to the desired direction of rod movement, and causes multiplier 158 to produce an appropriate multiplicand. The product of the error signal ($\pm e$), the multiplicand provided by multiplier 158, and the gain (K) of servoamplifier 162, is supplied to driver 122 which moves the sleeve appropriately relative to the body. If desired, the valve of the multiplicand may be such that the product of the multiplicand and the gain of the valve will be a constant. Again, the polarity of the error signal determines the direction of spool displacement.

If the load applied to the actuator rod is "opposing", valve 119 operates in the conventional manner. For example, if it is desired to move a leftward "opposing" load rightwardly, the driver would displace the spool rightwardly relative to the body. In this displaced condition of the spool, supply pressure from conduit 129 would be admitted through the relatively-large aggregate area of the left supply ports to the space between the left and middle spool lobes, and would flow through conduit 152 to enter the actuator left chamber 149. Conversely, fluid in actuator right chamber 150 could flow to return via conduit 153, the space between the spool middle and right lobes, and the relatively-small area of the right return ports. Since the aggregate orifice area of either of the return ports is substantially smaller than the aggregate orifice area of either of the supply ports, actuator displacement would be effectively controlled by flow through the smaller-area return orifices.

On the other hand, if it is desired to move the actuator rod in the same direction as an "aiding" load, the valve spool is moved in the appropriate direction to communicate the actuator expanding chamber with the fluid source, and to communicate the actuator contracting chamber with the fluid return. However, because the aggregate orifice area of the supply ports is on the order of four times the aggregate orifice area of the return ports, the actuator expanding chamber will be substantially at the supply pressure $P_s$. However, by definition, the "aiding" load will create a position pressure differential between the retracting and expanding actuator chambers. Hence, if the actuator expanding chamber is at supply pressure, the pressure in the actuator contracting chamber will be at some pressure greater than the supply pressure. This pressure differential will cause the appropriate one of the bypass conduit check valves to open, and fluid wil flow from the actuator contracting chamber through the appropriate bypass conduit and through the supply ports to the actuator expanding chamber. While some fluid bleeds to return through the smaller-area return ports, most of the fluid passes through the larger-area supply ports, which therefore provides effective control over displacement of the actuator rod. Since most of the actuator total flow goes through the check valve and bypass conduit, and only a small portion goes out the return port to be recirculated by the supply pump to the high pressure supply port, substantial energy is conserved relative to that dissipated by a conventional four-way servovalve. Thus, in the embodiment shown in FIG. 3*a*, when the improved valve is operated to displace an "opposing" load, effective control over the actuator rod is provided by the smaller-area return ports. However, when it is desired to move an "aiding" load, fluid flow is effectively controlled by the larger-area supply ports.

FIG. 3*c* illustrates an alternative form in which the bypass conduits 132, 134, and their associated check valves 133,135 have been removed, and the positions of the relatively-large and relatively-small sleeve slots hvae been reversed. In this embodiment, a first bypass passageway 163 communicates the space between the spool left and middle lobes with return conduit 126. This first bypass passageway has a check valve 164 therein to prevent fluid from flowing from the space between the spool left and middle lobes to return, but to permit reverse flow from the return to such space. The embodiment shown in FIG. 3*c* is also provided with a second bypass passageway 165 which communicates the space between the spool middle and right lobes with return conduit 131. Similarly, this second bypass passageway also incorporates a check valve 166, which is arranged to permit flow from the return to the space between the spool middle and right lobes, but not reversely. An optional third conduit 167 continuously communicates sleeve slots 168,171. As previously indicated, the positions of the relative-large and relatively-small sleeve slots provided through the sleeve, have been reversed. Hence, when the spool is in its null position, as shown in FIG. 3*c*, the left spool lobe is arranged to cover wide left return slots 168, the spool middle lobe is arranged to cover narrow left and right supply slots 169,170, and the spool right lobe is arranged to cover wide right return slots 171. Here again, the circumferential width ($w_r$) of each of return slots 168,171 may be on the order of four times the circumferential width ($w_p$) of each of supply slots 169,170.

If it is desired to move the actuator rod, say, rightwardly against an "opposing" load, driver 122 displaces spool 121 rightwardly relative to the body. The effect of this is to partially uncover the smaller-area left supply ports, and to permit flow therethrough into the actuator left chamber 149. At the same time, the actuator right chamber will communicate with return via the larger-area right return ports. Because of the difference in the aggregate cross-sectional areas of these ports, the right side of the actuator will be substantially at the return pressure, and control over actuator displacement will be effectively provided by the smaller-area supply ports. Of course, return conduits 126,131 may communicate with a common return (not shown), such as a sump.

However, if a rightward "aiding" load is applied to the actuator rod, the pressure in actuator right chamber 150 will increase, and the pressure in actuator left chamber 149 will decrease. If it is desired to move the actuator rod in the same direction as the "aiding" load, spool 121 is shifted rightwardly relative to the body. When this occurs, the higher pressure in actuator right chamber 150 is permitted to flow to return through the larger-area right return ports, which effectively control the flow. At the same time, some fluid will flow from the source through the smaller-area left supply ports to enter the actuator left chamber. However, additional fluid may also flow from return conduit 126 through bypass conduit 163 to enter actuator left chamber 149. Thus, as in the previously-described case, the energy-wasting flow through the pump is a small fraction of the recirculating flow.

Third Embodiment (FIG. 4)

Referring now to FIG. 4, another embodiment of an improved valve, generally indicated at 172, is shown as broadly including a body 173, a sleeve 174 mounted within the body, a valve spool 175, and an electromechanical driver 176. Valve 172 is shown as being operatively associated with a conventional double-acting fluid-powered actuator 178. Here again, the sleeve is mounted fast to the body.

Body 173 is shown as having a horizontally-elongated bore 179, from which five axially-spaced annular grooves extend radially into the body. The leftwardmost body groove 180 communicates with a fluid return (not shown) at a return pressure R via a passageway 181. The next-rightwardmost body groove is indicated at 182. The next-rightward body groove 183 communicates with a source (not shown) of pressurized fuid at a supply pressure $P_s$ via a conduit 184. The next-rightward body groove is indicated at 185. The rightward body groove 186 communicates with the fluid return via a passageway 188.

The tubular sleeve 174 is mounted fast within the body bore, and has an inwardly-facing cylindrical surface or bore 189. The sleeve is provided with four circumferentially-spaced radial through-slots at each of six axially-spaced locations therealong. The leftwardmost first sleeve slots, one of which is indicated at 190, are aligned with the first body groove 180. The second sleeve slots, one of which is indicated at 191, are aligned with second body groove 182. The third sleeve slots, one of which is indicated at 192, are aligned with the left margin of body groove 183. The fourth sleeve slots, one which is indicated at 193, are aligned with the right margin of body groove 183. The fifth sleeve slots, one of which is indicated at 194, are aligned with body groove 185. Finally, the rightwardmost sixth sleeve slots, one of which is indicated at 195, are aligned with right body groove 186. While only those slots which are arranged in the 6:00 o'clock positions have been numbered, it will be understood that the other slots of each circumferentially-spaced group are arranged in the 9:00 o'clock positions (not shown), at the 12:00 o'clock positions, and at the 3:00 o'clock positions (which are again shown in phantom elevation and cross-hatched for clarity). Each of supply and return slots 190, 192,193,195 is of substantially equal circumferential width (w), while each of bypass slots 191,194 is of substantially greater circumferential width (W). The ratio of such widths (W/w) may be on the order of four to one. However, while the exact ratio between these circumferential widths is not deemed to be particularly critical, and may be readily varied, it is presently preferred that the bypass slots be of substantially greater width than the supply and return slots. As before, the sleeve is mounted fast to and should be regarded as a part of the body.

The valve spool 175 is shown as having five lobes. When the spool is in its null position, as shown in FIG. 4, the leftward first lobe 196 covers left return slots 190, the next-rightward second lobe 198 will cover left bypass slots 191, the next-rightward third or middle lobe 199 will cover left and right supply slots 192,193, the next-rightward fourth lobe 200 will cover right bypass slots 194, and the rightward-most fifth lobe 201 will cover right return slots 195. Thus, if the spool is moved leftwardly off-null, the left lobe 196 will partially uncover slots 190 to form left return ports, the spool third lobe 199 will partially uncover right supply slots 193 to form right supply ports and the fourth lobe 200 will partially uncover bypass slots 194 to form right bypass ports. At the same time, left bypass slots 191, left supply slots 192, and right return slots 195, will each remain covered. Conversely, if the spool were to be moved rightwardly off-null, the spool second lobe 198 would partially uncover bypass slots 191 to form left bypass ports, the spool middle lobe 199 would partially uncover left supply slots 192 to form left supply ports, and spool rightward lobe 201 would partially uncover return slots 195 to form right return ports. At the same time, left return slots 196, right supply slots 193 and right bypass slots 104, will each remain covered.

The actuator 178 is again shown as having a piston 202 slidably mounted within a cylinder 203, and as subdividing the cylinder into a leftward chamber 204 and a rightward chamber 205. A rod 206 is fixed to the piston and sealingly penetrates both end walls of the cylinder.

A conduit 208 communicates the sleeve inner surface 189 between slots 191,192 with actuator left chamber 204. Another conduit 209 communicates the sleeve inner surface 189 between slots 193,194 with actuator right chamber 205. A third conduit 210 communicates the sleeve surface 189 between slots 190,191 with conduit 208, and a fourth conduit 211 communicates the sleeve surface 189 between slots 194,195 with conduit 209. A first bypass conduit 212 communicates conduit 209 with left bypass slots 191. This conduit is shown as containing a check valve 213 arranged to prevent flow from bypass slots 191 toward conduit 209, but to permit fluid from flowing reversely. A second bypass conduit 214 communicates conduit 208 with right bypass slots 104. This conduit is also shown as including a check valve 215 operatively arranged to prevent fluid flow from slots 194 toward conduit 208, but to permit flow in the reverse direction. Conduits 210,208 continuously communicate sleeve surface 189 between first and second slots 190,191 with another point on the sleeve surface between second and third slots 191,192. Similarly, conduits 209,211 continuously communicate the sleeve surface between fourth and fifth slots 193,194 with another point on the sleeve surface between the fifth and sixth slots 194,195.

If it is desired to move the actuator rod rightwardly against an "opposing" load, driver 176 is operated to displace the spool rightwardly relative to the sleeve and body. When this happens, the left return slots, the right supply slots and the right bypass slots, will each remain covered. However, the left bypass slots, the left supply slots and the right return slots, will all be partially uncovered by the same axial distance. In this condition, fluid may flow from the source through the left supply ports and may enter actuator left chamber 204. At the same time, fluid may flow from the actuator right chamber 205 through the right return ports to the return. The lower pressure in actuator right chamber 205 will be applied to the right side of check valve 213. However, the higher pressure in conduit 208 will be applied to the left side of this check valve through conduit 210, left bypass ports, and conduit 212. Hence, check valve 213 will remain closed. Thus, in moving an "opposing" load, actuator displacement is controlled by both of the appropriate supply and return ports, which are of the same aggregate cross-sectional orifice area and therefore have the same gain.

On the other hand, if a rightward "aiding" load is applied to the actuator rod, the pressure in actuator right chamber 205 will increase, and the pressure in actuator left chamber 204 will decrease. If it is now desired to move the actuator rod in the same direction as the "aiding" load, the driver is again operated to displace the spool rightwardly relative to the sleeve and body. In such displaced condition of the spool, the actuator left chamber 204 communicates with the source through the relatively-small left supply ports, and the actuator right chamber 205 communicates with the return through the relatively-small right return ports. The lower pressure in conduit 208 is applied to the left side of check valve 213, while the higher pressure in conduit 209 will be applied to the right side thereof. Hence, check valve 213 will open to permit the majority of flow to be from the actuator right chamber through bypass conduit 212 to the actuator left chamber, without drawing fresh pressurized fluid from the source. Specifically, the fluid in higher-pressure actuator right chamber 205 may pass through check valve 213, the larger-area left bypass ports 191, and conduit 210, and enter the lower-pressure actuator left chamber 204. Since, the aggregate cross-sectional area of the bypass ports is substantially greater than the aggregate cross-sectional area of the supply and return ports, effective control over actuator displacement will be provided by the bypass ports. In other words, as the actuator rod 206 begin to move in the same direction as the "aiding" load, the error signal is reduced. This causes the rightwardly-displaced spool to move leftwardly toward the null position, thereby decreasing the size of the supply and return ports. At the same time, the orifice defined by the left bypass ports is still relatively large, and this orifice provides effective control over the flow between the two actuator chambers.

Optional Throttle Valve 216 (FIGS. 5–6)

While the embodiments shown in FIGS. 3*a*, 3*c* and 4 offer the advantage of substantial energy conservation over conventional servovalves, it is appreciated that these embodiments may be further improved by selectively cutting off the unnecessary flow into or out of the valves in the case of an "aiding" load.

To this end, the valve shown in FIG. 3*a* may be associated with a simple, yet highly effective, spring-centered cut-off or throttling valve, such as indicated at 216 in FIG. 5. As best shown in FIG. 5*a*, valve 216 has a body 218 provided with a horizontally-elongated bore 219 and a pair of axially-spaced left and right abutment stops 220,221. A leftward annular groove 222 extends radially into the body from bore 219, and communicates with servovalve left return conduit 126. A rightward annular groove 223 extends radially into the body from bore 219, and communicates with servovalve right return conduit 131. Conduit 224 communicates bore surface 219 between grooves 222,223 with a common fluid return at a return pressure R. A two-lobed valve spool 225 is slidably mounted within the body bore, and is biased to the centered position shown in FIG. 5 by left and right centering springs 226,228, which are arranged in the left and right spool end chambers, respectively. The pressure $P_1$ in actuator left chamber 149 is supplied through a conduit 229, which may communicate with conduit 152, to act on the left end face of the spool. The pressure $P_2$ in the actuator right chamber 150 is supplied through conduit 230, which may communicate with conduit 153, to act on the right end face of the spool.

If $P_1=P_2$, springs 226,228 will center the spool relative to the body, as shown in FIG. 5. In this condition, the left and right spool lobes will partially uncover grooves 222, 223, and both of the return inlet conduits 126,131 will communicate with common return outlet conduit 224. However, if $P_2>P_1$, the spool will be driven leftwardly against abutment stop 220. In this condition, the left return conduit 126 will be fully uncovered, and will continue to communicate with common outlet 224, while the right spool lobe will cover right body groove 223, thereby blocking communication between right return conduit 131 and common outlet 224. Alternatively if $P_1>P_2$, the spool will be driven rightwardly against abutment stop 221. In this condition, groove 223 wil be fully uncovered and right return conduit 131 will communicate with common outlet 224. However, the spool left lobe will cover groove 222, thereby blocking communication between conduits 126,224. Thus, when an "opposing" load is applied to actuator rod 151, the polarity of the pressure differential between actuator chambers 149,150 will displace the throttling piston in the appropriate direction to continue to communicate the appropriate servovalve return port with the common return outlet 224. However, if the actuator load is "aiding", the opposite polarity of the pressure differential between chambers 149,150 will displace the throttling piston so as to block flow from the uncovered main valve return port to the common return. In this manner, the throttling valve may be used to selectively cut off the flow to return when an "aiding" load is applied to the actuator in FIG. 3*a*.

Persons skilled in this art will also appreciate that throttling valve 216 may be used in association with the third embodiment shown in FIG. 4, to cut off the flow to return. As shown in FIG. 6, the throttling valve may be associated with servovalve 172 such that the servovalve left return conduit 181 communicates with body groove 222, and the servovalve right return conduit 188 communicates with body groove 223. A conduit 231, which communicates with actuator left chamber 204, supplies actuator pressure $P_1$ to the throttling valve left spool end chamber. Another conduit 232, which communicates with actuator right chamber 205, supplies actuator pressure $P_2$ to the throttling valve right spool end chamber. Thus, the pressures in the two actuator chambers are applied to the opposite ends of the throttling valve spool end chambers, and a differential between such pressures will selectively drive spool 225 either leftwardly or rightwardly, as appropriate, to completely cut off flow to return when the load is "aiding". However, the throttling valve will continuously communicate the appropriate return conduit, 181 or 188, with common return 224 when the load is "opposing".

Modified Throttle Valve with Integral Check Valve Function (FIGS. 7–9)

If desired, the throttling valve 216 may be modified to further provide the function of check valves.

Referring now to FIG. 7, such a modified throttling valve, generally indicated at 216A, is shown as being substantially similar to the throttling valve 216, described supra. However, the modified form is further provided with left and right annular grooves 233,234 which extend into body 218 from bore surface 219 between left abutment surface 220 and groove 222, and between groove 223 and right abutment surface 221, respectively. Left groove 233 is positioned such that when spool 225 is in its centered or null position, the left marginal end portion of the spool left obe will just cover groove 233. Conversely, groove 234 is positioned such that when the spool is centered, as shown in FIG. 7, the right marginal end portion of the spool right lobe will just cover groove 234. Hence, if the throttling valve spool is shifted leftwardly relative to the body, groove 233 will remain covered, but groove 234 will communicate with the right spool end chamber. Conversely, if the spool is shifted rightwardly off-null, groove 234 will remain covered, but groove 233 will communicate with the left spool end chamber.

As best shown in FIG. 8, the modified throttling valve 216A may be operatively associated with the four-way servovalve 119 and actuator 123 shown in FIG. 3*a*. The first and second bypass conduits 132,134, and their associated check valves 133, 135, have been eliminated. Servovalve return conduits 126,131 communicate with throttling valve grooves 222,223, respectively. Supply pressure $P_s$ is admitted via branch conduit 129 and manifold 128 to servovalve supply slots 140,141, and also passes via conduit 235 and branch conduit 236 to throttling valve grooves 233,234. A conduit 238 continuously communicates the space between servovalve left and middle lobes 143,144 with the throttling valve spool left end chamber. Another conduit 239 continuously communicates the space between servovalve middle and right lobes 144,145 with the throttling valve spool right end chamber. Thus, left and right spool end chambers are at actuator pressures $P_1$, $P_2$, respectively.

The throttling valve 216A is therefore operatively arranged to sense the polarity of the applied load in terms of the differential between actuator pressures $P_1$ and $P_2$. On the other hand, the direction of movement of servovalve spool 121 represents the desired direction of load movement. If $P_1=P_2$, the throttling valve spool will be in its centered or null position, as shown in FIG. 8, at which both of the return conduits 126,131 will communicate with common return line 224. However, flow through conduit 236 will be blocked by the throttling valve spool left and right lobes, which cover body grooves 233,234 respectively. If $P_1>P_2$, the throttling valve spool will be driven rightwardly against abutment surface 221, thereby fully uncovering return groove 223, covering return groove 222, and uncovering groove 233 so as to permit flow from conduit 238 to conduit 236. Conversely, if $P_2>P_1$, the throttling valve will be driven leftwardly against abutment surface 220, thereby uncovering groove 222, covering groove 223, and uncovering groove 234 so as to permit flow from conduit 239 to conduit 236. Conduit 236 communicates with the fluid source and with servovalve supply conduit 129.

If a rightward load is applied to the actuator rod 151, when spool 121 is in its null position, the pressure $P_2$ in the actuator right chamber 150 will be greater than the pressure $P_1$ in the actuator left chamber 149. This differential, $P_2>P_1$, will displace the throttling valve spool leftwardly to cut off flow in servovalve return line 131. If it is desired to move this load leftwardly, so that the load is "opposing" with respect to the desired direction of actuator movement, servovalve spool 121 is moved leftwardly off null. As this occurs, fluid at $P_s$ from the source is admitted to the servovalve through supply conduit 129, passes through the uncovered right supply port, to expand actuator right chamber 150. At the same time, return fluid from the contracting left chamber 149 passes through the servovalve left return port, conduit 126, the throttling valve, to common return 224. However, if it were alternatively desired to move this same load rightwardly, so that the load would be "aiding" with respect to the desired direction of actuator movement, the servovalve spool would be shifted rightwardly off-null. Fluid from supply would quickly pressurize the left actuator chamber 149 to the magnitude of $P_s$, and the right actuator chamber would therefore be at some pressure greater than $P_s$ because of the applied load. Fluid would flow from the contracting right actuator chamber 150 through conduits 153,239,236,235, 129,128, the servovalve left supply port, and conduit 152, to enter the expanding left actuator chamber.

Thus, in this embodiment, the modified throttling valve 216A performs the function of check valves 133, 135, which have been eliminated. At the same time, the throttling valve completely cuts off the flow to return in the case of an "aiding" load, thereby conserving energy, while permitting normal operation of the servovalve when the load is "opposing".

If desired, a further modified form of this throttling valve may be associated with the valve shown in FIG. 3*c*, to completely cut off the flow from the source when the load is "aiding" with respect to the desired direction of actuator movement.

Referring now to FIG. 9, this embodiment of the throttling valve 216B is associated with servovalve 119 and actuator 123. The first and second bypass conduits 163,165, and their associated check valves 164,166, have been eliminated. Moreover, servovalve body middle groove 128 has been modified so that sleeve supply slots 169, 170 do not communicate with one another.

Throttling valve 216B has a body 240 provided with a horizontally-elongated bore 241. Four axially-spaced annular grooves 242,243,244,245 extend radially into the body. A spring-centered valve spool 246, having four lobes 248,249,250,251, is slidably mounted within the bore and is biased to a null position by left and right springs 252,253. In this null position, as shown in FIG. 9, first lobe 248 covers groove 242, second lobe 249 partially covers groove 243, third lobe 250 partially covers lobe 244, and fourth lobe 251 covers groove 245. A conduit 254 communicates a suitable fluid source (not shown) at a supply pressure $P_s$, with the body bore between grooves 243,244. Groove 243 communicates with servovalve right supply groove 170 via conduit 255, and groove 244 communicates with servovalve left supply groove 169 via conduit 256. Groove 242 communicates with return via conduit 258, and with servovalve left return groove 168 via conduit 259. Groove 245 communicates with return via conduit 260, and with servovalve right return groove 171 via conduit 261. Conduit 262 communicates the space between servovalve lobes 143,144 within the throttling valve spool left end chamber. A conduit 263 communicates conduit 262 with the space between throttling valve spool lobes 248,249. Conduit 264 communicates the space between servovalve lobes 144,145 with the throttling valve spool right end chamber. Conduit 265 communicates conduit 264 with the space between throttling valve lobes 250,251. Thus, the pressure $P_1$ in actuator left chamber 149 is provided to the throttling valve spool left chamber, and the space between lobes 248,249. The pressure $P_2$ in actuator right chamber 150 is provided to throttling valve spool right end chamber and to the space between lobes 250,251.

Here again, the polarity of the actual load pressure differential, $P_1-P_2$, is used to displace spool 242 either leftwardly or rightwardly, as appropriate between abutment stops 266,268. The position of servovalve spool 121 relative to its body determines the desired direction of actuator movement.

Assume that a rightward load is applied to actuator rod 151. Since $P_2>P_1$, the throttling valve spool 242 will be driven leftwardly against abutment stop 266. When this happens, lobe 249 will completely uncover groove 243, but lobe 250 will cover lobe 244, thereby preventing flow through conduit 256 to return. If it is desired to move the actuator rod leftwardly, so that the load "opposes" the desired direction of actuator movement, servovalve spool 121 is shifted leftwardly. Pressurized fluid from the source passes through conduits 254,255, the servovalve right supply port, and conduit 153 to enter actuator right chamber 150. Conversely, fluid in actuator left chamber 149 flows to return through communicating conduits 152,259 and 258.

However, if it is desired to move the load rightwardly, so that the load will "aid" the desired direction of movement, the servovalve spool is displaced rightwardly off-null. However, since $P_2>P_1$, flow through supply conduit 256 is blocked by the leftwardly-displaced throttling valve spool. However, fluid in the contracting right actuator chamber may flow to return via conduits 153,261, annular groove 245, and conduit 260. At the same time, fluid may be drawn into the expanding actuator chamber 149 from return via conduits 258,263,262 and 152. Thus, while this embodiment does contemplate some fluid bleed to return, the throttling valve blocks the flow of fresh pressurized fluid at supply pressure $P_s$ from entering the expanding actuator chamber.

Modified FIG. 4 Embodiment with Modified Throttling Valve (FIG. 10)

If desired, a modified form of the servovalve shown in FIG. 4 may be associated with a further modified throttling valve to completely cut off fluid flow from supply and to return in the case of an "aiding" load.

Referring now to FIG. 10, the modified servovalve 172A is shown as being associated with actuator 178 and with modified throttling valve 216C. Servovalve 172A has a body 173 provided with a horizontally-elongated cylindrical bore 179. Six axially-spaced annular grooves 269,270,271,272,273,274 extend radially into the body from bore surface 179. Tubular sleeve 174 is arranged within the bore, and is mounted fast to the body. Sleeve slots 190,191,192,193,194,195 communicate with body grooves 269,270,271,272,273,274, respectively. The servovalve also includes a five-lobed spool, generally indicated at 175, the position of which relative to the sleeve is controlled by driver 176. When the spool is in the null position, as shown in FIG. 10, leftwardmost lobe 196 covers sleeve slots 190, lobe 198 covers sleeve slots 191, lobe 199 covers sleeve slots 192,193,lobe 200 covers sleeve slots 194, and lobe 201 covers sleeve slots 195. The spool 175 and sleeve 174 are as previously described. However, the servovalve body is modified in that grooves 271,272 have replaced common body groove 184 of the FIG. 4 embodiment. Also, the arrangement and connections of the various conduits have been changed, as described below.

Conduit 208 communicates the actuator left chamber 209 with sleeve bore 189 between spool lobes 198,199, and conduit 210 communicates conduit 208 with sleeve bore 189 between spool lobes 196,198. Conversely, conduit 204 communicates actuator right chamber 205 with sleeve bore 189 between spool lobes 199,200, and conduit 211 communicates conduit 209 with sleeve bore 189 between spool lobes 200,201. However, in the FIG. 10 modification, bypass conduits 212,214, together with their associated check valves 213,215, respectively, have been eliminated.

The modified throttling valve 216C includes a body 275 provided with a horizontally-elongated cylindrical bore 276. Six axially-spaced annular grooves 278, 279,280,281,282,283 extend radially into the body from bore surface 276. A four-lobed valve spool, generally indicated at 284, is arranged within bore 276 for sliding movement therealong, and is biased to a centered or null position by opposing springs 285, 286 in the throttling valve spool and chambers. When the spool is in its null position, as shown in FIG. 10, the left margin of leftwardmost lobe 288 covers body groove 278, the right margin of lobe 288 partially covers body groove 279, the right margin of next-rightward lobe 289 partially uncovers body groove 280, the left margin of next-rightward lobe 290 partially uncovers body groove 281, the left margin of rightwardmost lobe 291 partially covers body groove 282, and the right margin of lobe 291 covers body groove 283. Thus, spool 284 is mounted for sliding movement along bore 276 between left and right abutment stops 292,293. When the spool is shifted leftwardly off-null to abut left stop 292, grooves 279,280,283 will be uncovered, while grooves 278,281,282 will be covered. Conversely, when the spool is shifted rightwardly and abuts right stop 293, grooves 278,281,282 will be uncovered, and grooves 279,280,283 will be covered.

A conduit 294 admits pressurized fluid at supply pressure at $P_s$ from a source (not shown) to throttling bore 276 between grooves 280,281. Conduit 295 communicates bore surface 276 between groves 279,280 with a fluid return at a return pressure R. Similarly, conduit 296 communicates bore surface 276 between body grooves 281,282 with the return.

Conduit 298 communicates servovalve bore surface 189 between slots 190,191 with the throttling valve spool left end chamber. Conduit 299 communicates servovalve body groove 269 with throttling body groove 279. Conduit 300 communicates throttling body groove 278 with servovalve body groove 273. Conduit 301 communicates throttling body groove 280 with servovalve body groove 272. Conduit 302 communicates throttling body groove 281 with servovalve body groove 271. Conduit 303 communicates throttling body groove 283 with servovalve body groove 270. Conduit 304 communicates throttling body groove 282 with servovalve body groove 274. Conduit 305 communicates the throttling valve spool right end chamber with servovalve sleeve bore 189 between sleeve slots 194,195.

Thus, for example, assume that a rightward load is applied to actuator rod 206. Hence, the pressure $P_2$ in actuator right chamber 205 will be greater than the pressure $P_1$ in actuator left chamber 204. Since $P_2 > P_1$, the throttling valve spool will be shifted leftwardly to abut stop 292. If it is desired to move this load leftwardly, so that the load is "opposing" with respect to the desired direction of actuator movement, driver 176 is operated to shift servovalve spool 175 to the left. Thus, pressurized fluid may flow from the source through conduits 294,301, the now-uncovered servovalve right supply ports, and conduit 209, to enter the expanding actuator right chamber 205. At the same time, fluid may flow from contracting actuator left chamber 204 through conduits 208,210, the now-uncovered servovalve left return ports, and conduits 299,295, to return.

If it is alternatively desired to move this load rightwardly, so that the load will be "aiding" with respect to the desired direction of actuator movement, driver 176 is operated so as to shift servovalve spool 175 rightwardly off-null. Since $P_2 > P_1$, throttling valve spool 284 will still abut left stop 292. However, fluid in the contracting actuator right chamber 205 will be constrained to flow through conduits 209, 211,305,303,210 and 208, to enter the expanding actuator left chamber 204. At the same time, the throttling valve will completely cut off fluid flow from the supply or to the return. Hence, no fresh pressurized fluid from the source will be admitted to the actuator when it is desired to move the actuator rod in the same direction as an "aiding" load.

Figure 11:
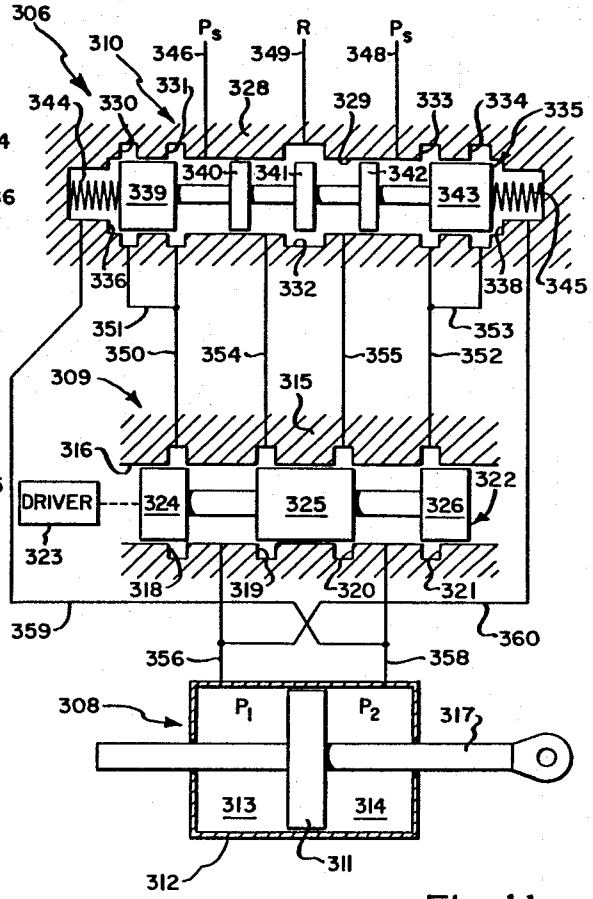
FIG. 11 is a schematic view of yet another form of an improved servomechanism which functions to completely cut off fluid flow from the source and to the return in the case of an "aiding" load.

Simplified Servomechanism 306 (FIG. 11)

Referring now to FIG. 11, a simplified servomechanism, generally indicated at 306, is shown as broadly including a double-acting fluid-powered actuator 308, an electrohydraulic servovalve 309, and a throttling valve 310.

Actuator 308 is shown as having a piston 311 slidably mounted within a cylinder 312, and as separating a leftward or first actuator chamber 313 from a rightward or second actuator chamber 314. The pressures within the first and second actuator chambers are again indicated as being $P_1$,$P_2$, respectively.

Servovalve 309 has a body 315 provided with a horizontally-elongated cylindrical bore 316. Four axially-spaced annular grooves 318,319,320,321 extend radially into body 315 from bore surface 316. A three-lobed valve spool 322 is slidably mounted within the bore. Spool 322 may be selectively displaced in the appropriate axial direction relative to body 315, either leftwardly or rightwardly, as desired, by an electromechanical driver 323. When spool 322 is in its null position relative to the body, the right margin of left lobe 324 just covers body groove 318, the left and right margins or middle lobe 325 just cover second and third body grooves 319,320, and the left margin of right lobe 326 just covers fourth body groove 321. Thus, if spool 322 is shifted leftwardly off-null, body grooves 318,320 will be uncovered, while body grooves 319,321 will remain covered. Conversely, if spool 322 is shifted rightwardly off-null, grooves 319,321 will be uncovered, while body grooves 318,320 will remain covered.

The throttling valve 310 is shown having a body 328 provided with a horizontally-elongated cylindrical bore 329. Five axially-spaced annular grooves 330, 331,332,333,334 extend radially into the body from bore surface 329. A five-lobed valve spool, generally indicated at 335, is mounted within this bore for longitudinal sliding movement therealong between left and right abutment stops 336,338, respectively. When the throttling valve spool is in its null position, as shown in FIG. 11, left margin of leftwardmost lobe 339 just covers body groove 330; the right margin of lobe 339 partially covers body groove 331; the next-rightward lobe 340 is positioned between body grooves 331,332; next-rightward lobe 341 is centered with respect to, but only partially covers, body groove 332, next-rightward lobe 342 is positioned between body grooves 332,333; the left margin of rightwardmost lobe 343 partially covers body groove 333; and the right margin of lobe 343 just covers body groove 334. The spool 335 is biased toward a centered or null position by opposing left and right centering springs 344,345 in the left and right spool end chambers, respectively. In the illustrated null position, the spool end faces are spaced equally from the proximate abutment stops 336,338. Thus, if the spool is shifted leftwardly so as to abut stop 336, body grooves 330,333 will be covered, body grooves 331,334 will be uncovered, and middle body groove 332 will only communicate with the space between lobes 341,342. Conversely, if the spool is shifted rightwardly so as to abut stop 338, body grooves 331,334 will be covered, body grooves 330,333 will be uncovered, and middle body groove 332 will only communicate with the space between lobes 340,341.

Pressurized fluid at supply pressure $P_s$ is continuously supplied to the throttling valve bore between lobes 339,340 by conduit 346, and is also continuously supplied to this bore between lobes 342,343 by a conduit 348. Another conduit 349 communicates middle body groove 332 with a fluid return at a return pressure R.

Conduit 350 communicates throttling groove 331 with servovalve groove 318. Branch conduit 351 communicates conduit 350 with throttling groove 330. Conduit 352 communicates throttling groove 333 with servovalve groove 321. Branch conduit 353 communicates conduit 352 with throttling groove 334. Conduits 354,355 communicate the spaces between throttling valve spool lobes 340,341 and 341,342 with servovalve grooves 319 and 320, respectively. Conduits 356,358 communicate the spaces between servovalve spool lobes 324,325 and 325,326 with actuator chambers 313 and 314, respectively. Conduit 359 communicates conduit 358 with the throttling valve left spool end chamber, and conduit 360 communicates conduit 356 with the throttling valve right spool end chamber. Thus, the pressure $P_1$ in actuator left chamber 313 is supplied to the throttling valve right spool end chamber, while the pressure $P_2$ in actuator right chamber 314 is supplied to the throttling valve left spool end chamber.

Assume, for example, that a rightward load is applied to actuator rod 317. Hence, by definition, $P_2 > P_1$, and throttling valve spool 335 will be shifted rightwardly to abut stop 338. If it is now desired to move this load leftwardly, so that the load opposes the desired direction of actuator movement, driver 323 is operated to displace servovalve spool 322 rightwardly off-null. Hence, pressurized fluid may flow through conduits 348,352,358 to enter the actuator right chamber 314. At the same time, fluid may flow from the actuator left chamber 313 through conduits 356,354,349 to return.

On the other hand, if it is alternately desired to move this laod rightwardly, so that the load aids the desired direction of actuator movement, driver 323 shifts the servovalve spool leftwardly off-null. In this situation, fluid will be constrained to flow from the higher pressure actuator chamber 314 through conduits 358, 359,351,350,356 to the lower pressure actuator chamber 313. At the same time, flow from supply and to return is completely cut off by the throttling valve. Thus, the throttling valve allows the servovalve to provide conventional control over actuator displacement in the case of an "opposing" load. However, in the case of an "aiding" load, the throttling valve selectively isolates the servomechanism from supply and return, while the servovalve provides continued control as fluid is directed to flow from the higher pressure actuator chamber to the lower pressure actuator chamber. Thus, energy is conserved because fresh pressurized fluid from the source will be prevented from entering the expanding actuator chamber in the case of "aiding" load.

Therefore, while several preferred forms of the improved energy-conserving servomechanism and valve arrangement have been shown and described, and several modifications thereof discussed, persons skilled in this art will readily appreciate that various additional changes and modifications may be made without departing from the spirit of the invention, as defined and differentiated by the following claims.

What is claimed is:

1. In a servomechanism associated with a source of pressurized fluid at a supply pressure, the improvement which comprises:

a first valve and a second valve, each of said valves having one member movable relative to another member, each of said other members having a supply opening communicating with said source, having a return opening, and having a control opening, each of said one members being movable within a first positional range relative to the associated other member to increase the pressure at the associated control opening and being movable within a second positional range to decrease the pressure at the associated control opening;

a first conduit communicating one of said first valve supply and return openings with the like one of said second valve supply and return openings;

a first driver operatively arranged to move said first valve one member to a desired position relative to said first valve other member;

a second driver operatively arranged to move said second valve one member to a desired position relative to said second valve other member;

a sensor for determining a pressure differential at said first and second valve control openings; and a controller operatively associated with said sensor and with said drivers for causing said first valve one member to move to an appropriate position within one of its positional ranges and for causing said second valve one member to move to an appropriate position within the other of its positional ranges when the pressure at one of said control openings is greater than the pressure at the other of said control openings, and for causing both of said first and second valve one members to move to appropriate positions within like ones of said positional ranges when the pressure at said one control opening is less than the pressure at said other control opening.

2. The improvement as set forth in claim 1 wherein said first conduit communicates said first valve supply opening with said second valve supply opening.

3. The improvement as set forth in claim 2 wherein the pressure drops across said valves are substantially the same when both of said valve one members have been moved to said appropriate positions.

4. The improvement as set forth in claim 3 wherein said first and second ranges are located on either side of a null position at which said control openings do not communicate with either of said supply and return openings.

5. The improvement as set forth in claim 4 wherein said appropriate positions are such taht said first valve one member is displaced from its null position by a distance substantially equal to the displacement of said second valve one member from its null position.

6. The improvement as set forth in claim 1 wherein said first conduit communicates said first valve return opening with said second valve return opening.

7. The improvement as set forth in claim 6 and further comprising a fluid sump communicating with said return openings, a second conduit communicating said sump with said first valve control opeing, a third conduit communicating said sump with said second valve control opening, and wherein each of said second and third conduits includes a check valve operatively arranged to prevent fluid from flowing toward said sump.

8. The improvement as set forth in claim 6 wherein the pressure drops across said valves are substantially the same when both of said valve one members have been moved to said appropriate positions.

9. The improvement as set forth in claim 8 wherein said first and second ranges are located on either side of a null position at which said control openings do not communicate with either of the associated supply and return openings.

10. The improvement as set forth in claim 9 wherein said appropriate position are such that said first valve one member is displaced from its null position by a distance substantially equal to the displacement of said second valve one member from its null position.

11. The improvement as set forth in claim 1 wherein said first valve other member is a body provided with a bore, wherein said first valve one member is a spool slidably mounted within said bore.

12. The improvement as set forth in claim 1 wherein said second valve other member is a body provided with a bore, and wherein said second valve one member is a spool slidably mounted within said bore.

13. The improvement as set forth in claim 1 and further comprising an actuator having a piston slidably mounted in a cylinder, said piston separating a first chamber on one side thereof from a second chamber on the other side thereof, and wherein said first valve control opening communicates with said actuator first chamber and said second valve control opening communicates with said actuator second chamber.

14. A servomechanism, comprising:

a fluid-powered actuator having opposing first and second chambers;

a first servovalve having a supply slot communicating with a fluid source, having a return slot communicating with a fluid return, and being operatively arranged to control the flow of fluid with respect to said first chamber;

a second servovalve having a supply slot communicating with a fluid source, having a return slot communicating with a fluid return, and being operatively arranged to control the flow of fluid with respect to said second chamber;

each of said servovalves having a member selectively movable off-null in one direction to uncover a supply port and movable off-null in the opposite direction to uncover a return port;

a bypass conduit communicating one of said first servovalve supply and return slots with the like one of said second servovalve supply and return slots;

a sensor operatively arranged to sense a differential of the pressures in said first and second chambers; and a controller associated with said sensor and with said servovalves such that when an external load applied to said actuator opposes the desired direction of actuator movement, said servovalves will be operated such that fluid will flow to the higher pressure chamber and from the lower pressure chamber, but when said external load aids the desired direction of actuator movement, said servovalves will be operated to permit fluid flow from the higher pressure chamber to the lower pressure chamber through said bypass conduit.

15. A servomechanism as set forth in claim 14 wherein said bypass conduit communicates said first servovalve supply port with said second servovalve supply port.

16. A servomechanism as set forth in claim 15 wherein when an aiding load is applied to said actuator, each of said servovalve members is moved off-null in said one direction.

17. A servomechanism as set forth in claim 14 wherein said bypass conduit communicates said first servovalve return port with said second servovalve return port.

18. A servomechanism as set forth in claim 17 wherein when an aiding load is applied to said actuator, each of said servovalve members is moved off-null in said opposite direction.

19. A servomechanism as set forth in claim 14 wherein the flow gains of said supply ports are substantially the same, and the flow gains of said return ports are substantially the same.

20. A servomechanism adapted to be associated with a source of pressurized fluid, comprising:

a fluid-powered actuator having opposing first and second chambers;

a body provided with a bore, said body having first and second supply openings and first and second return openings joining said bore, each of said supply openings communicating with said source;

a valve spool mounted in said bore for longitudinal sliding movement relative thereto, said spool having a plurality of lobes arranged such that when said spool is in a null position relative to said body, each of said supply and return openings will be covered, said spool being movable off-null in one direction to uncover a first supply port communicating said first chamber with said first supply opening and to uncover a second return port communicating said second chamber with said second return opening, said spool being movable off-null in the opposite direction to uncover a first return port communicating said first chamber with said first return opening and to uncover a second supply port communicating said second chamber with said second supply opening, the gains of said supply ports being substantially different from the gains of said return ports;

a driver operatively arranged to move said spool to a desired position relative to said body;

a first passageway continuously communicating one of said first supply and first return openings with said first chamber, said first passageway having a first check valve operatively associated therewith to permit only unidirectional fluid flow through said first passageway; and a second passageway continuously communicating the like one of said second supply and second return openings with said second chamber, said second passageway having a second check valve operatively associated therewith to permit only unidirectional fluid flow through said second passageway;

whereby, when said spool is moved off-null and if the load applied to said actuator opposes the desired direction of actuator movement, fluid may flow through one of said supply ports to the higher pressure chamber and through one of said return ports through the lower pressure chamber, but if such load aids the desired direction of actuator movement, fluid may flow from the higher pressure chamber to the lower pressure chamber through one of said first and second passageways.

21. A servomechanism as set forth in claim 20 wherein said first passageway communicates said first chamber with said first supply opening, wherein said second passageway communicates said second chamber with said second supply opening, and wherein said first and second check valves are arranged to prevent flow into said chambers.

22. A servomechanism as set forth in claim 20 wherein said first passageway communicates said first chamber with said first return opening, wherein said second passageway communicates said second chamber with said second return opening, and wherein said first and second check valves are arranged to prevent flow from said chambers.

23. A servomechanism as set forth in claim 20 wherein each of said supply ports has a gain substantially greater than thegain of either of said return ports.

24. A servomechanism as set forth in claim 20 wherein each of said return ports has a gain substantially greater than the gain of either of said supply ports.

25. A servomechanism as set forth in claim 20 wherein said first passageway is provided in said body.

26. A servomechanism as set forth in claim 20 wherein said second passageway is provided in said body.

27. A servomechanism adapted to be associated with a source of pressurized fluid, comprising:

a fluid-powered actuator having opposing first and second chambers;

a body provided with a bore, said body having first and second supply openings and first and second return openings joining said bore, each of said supply openings communicating with said source;

a valve spool mounted in said bore for longitudinal sliding movement relative thereto, said spool having a plurality of lobes arranged such that when said spool is in a null position relative to said body, each of said supply and return openings will be covered, said spool being movable off-null in one direction to uncover a first supply port communicating said first chamber with said first supply opening and to uncover a second return port communicating said second chamber with said second return opening, said spool being movalbe off-null in the opposite direction to uncover a first return port communicating said first chamber with said first return opening and to uncover a second supply port communicating said second chamber with said second supply opening;

a driver operatively arranged to move said spool to a desired position relative to said body; and a throttling valve operatively arranged to prevent flow through the associated return port when said spool is moved off-null and the load applied to said actuator is aiding with respect to the desired direction of actuator movement.

28. A servomechanism as set forth in claim 27 and further comprising a first bypass passageway communicating one of said first supply and first return openings with said first chamber, said first passageway having a first check valve operatively associated therewith to permit only unidirectional fluid flow through said first bypass passageway.

29. A servomechanism as set forth in claim 28 wherein said first bypass passageway communicates said first supply opening with said first chamber, and wherein said first passageway is arranged to only permit flow from said first chamber to said first supply opening.

30. A servomechanism as set forth in claim 28 wherein said first bypass passageway communicates said first return opening with said first chamber, and wherein said first passageway is arranged to only permit flow from said first return opening to said first chamber.

31. A servomechanism as set forth in claim 27 and further comprising a second bypass passageway communicating one of said second supply and return openings with said second chamber, said second passageway having a second check valve operatively associated therewith to permit only unidirectional fluid flow through said second bypass passageway.

32. A servomechanism as set forth in claim 31 whereins aid second bypass communicates with said second supply opening with said second chamber, and wherein said second check valve is arranged to only permit flow from said second chamber to said second supply opening.

33. A servomechanism as set forth in claim 31 wherein said second bypass passageway communicates said second return opening with said second chamber, and wherein said second check valve is arranged to only permit flow from said second return opening to said second chamber.

34. A servomechanism as set forth in claim 27 wherein said throttling valve includes a second body provided with a second bore, and includes a second valve spool mounted in said second bore for longitudinal sliding movement therealong, wherein said second body is provided with first and second bypass openings which join said second bore, wherein said second spool has a plurality of lobes such that when said second spool is in a null position relative to said second body the lobes of said second spool will cover said first and second bypass openings, said second spool being movable off-null in one direction to communicate said first bypass opening with said first chamber, said second spool being movable off-null in the opposite direction to communicate said second bypass opening with said second chamber.

35. A servomechanism as set forth in claim 34 wherein each of said first and second bypass openings communicate with said source.

36. A servomechanism as set forth in claim 34 wherein said first and second bypass openings communicate with a fluid return.

37. A servomechanism as set forth in claim 34 wherein said second spool moves in said one direction when the pressure in said first chamber is greater than the pressure in said second chamber, and moves in said opposite direction when the pressure in said second chamber is greater than the pressure in said first chamber.

38. A servomechanism, comprising:

a fluid-powered actuator having opposing first and second chambers;

a four-way electrohydraulic servovalve arranged to control the flow of fluid with respect to said first and second chambers, said servovalve having a member movable off-null in one direction to uncover a first supply port and a first return port, and being movable off-null in the opposite direction to uncover a second supply port and a second return port, the gains of said supply ports being substantially greater than the gains of said return ports;

a first conduit communicating said first chamber with the fluid supply to said servovalve, said first conduit having a first means to permit only unidirectional flow from said first chamber to said supply;

a second conduit communicating said second chamber with said fluid supply, said second conduit having a second means to permit only unidirectional flow from said second chamber to said fluid supply;

whereby, when said servovalve is operated to cause a desired direction of actuator movement and an external load is applied to said actuator which opposes said desired direction of actuator movement, fluid will flow from supply to the higher pressure chamber and from the lower pressure chamber to return, but when said external load aids the desired direction of actuator movement, fluid will flow fromthe higher pressure chamber through one of said first and second conduits to the supply, and thence to the lower pressure chamber.

39. A servomechanism, comprising:

a fluid-powered actuator having opposing first and second chambers;

a four-way electrohydraulic servovalve arranged to control the flow of fluid with respect to said first and second chambers, said servovalve having a member movable off-null in one directin to uncover a first supply port and a first return port, and being movable off-null in the opposite direction to uncover a second supply port and a second return port, the gains of said return ports being substantially greater than the gains of said supply ports;

a first conduit communicating said first chamber with the fluid return from said servovalve, said first conduit having a first means to permit only unidirectional flow from said return to said first chamber;

a second conduit communicating said second chamber with said fluid return, said second conduit having a second means to permit only unidirectional flow from said return to said second chamber;

whereby, when said servovalve is operated to cause a desired direction of actuator movement and an external load is applied to said actuator which opposes said desired direction of actuator movement, fluid will flow from supply to the higher pressure chamber and from the lower pressure chamber to return, but when said external load aids the desired direction of actuator movement, fluid will flow from the higher pressure chamber to the return, and thence through one of said first and second conduits to the lower pressure chamber.

40. A servomechanism adapted to be associated with a source of pressurized fluid, comprising:

a fluid-powered actuator having opposing first and second chambers;

a body provided with a bore, said body having first and second supply openings, first and second return openings, and first and second bypass openings, each of said supply openings communicating with said source;

a valve spool mounted in said bore for longitudinal sliding movement therealong, said spool having a plurality of lobes arranged such that when said spool is in a null position relative to said body, each of said openings will be covered, said spool being movable off-null in one direction to uncover a first return port communicating said first chamber with said first return opening, to uncover a second bypass port, and to uncover a second supply port communicating said second chamber with said source, said spool being movable off-null in the opposite direction to uncover a second return port communicating said second chamber with said second return opening, to uncover a first bypass port, and to uncover a first supply port communicating said first chamber with said source;

a driver operatively arranged to selectively move said spool to a desired position relative to said body;

a first passageway continuously communicating said first bypass opening with said second chamber, said first passageway having a first check valve therein operatively arranged to prevent flow toward said second chamber;

a second passageway continuously communicating said second bypass opening with said first chamber, said second passageway having a second check valve therein operatively arranged to prevent flow toward said first chamber;

whereby, when said servomechanism is operated such that an external load applied to said actuator opposes the desired direction of actuator movement, fluid will flow from supply to the higher pressure chamber and from the lower pressure chamber to return, but when said servomechanism is operated such that an external load applied to said actuator aids the desired direction of actuator movement, fluid will be permitted to flow from the higher pressure actuator chamber to the lower pressure actuator chamber through one of said bypass openings.

41. A servomechanism as set forth in claim 40 wherein each of said supply and return ports has the same gain.

42. A servomechanism as set forth in claim 41 wherein each of said first and second bypass ports has the same gain.

43. A servomechanism as set forth in claim 42 wherein the gain of said bypass ports is substantially greater than the gain of said supply and return ports.

44. A servomechanism adapted to be associated with a source of pressurized fluid, comprising:

a fluid-powered actuator having opposing first and second chambers;

a body provided with a bore, said body having first and second supply openings communicating with said source, first and second return openings, and first and second bypass openings, each of said openings communicating with said bore;

a valve spool mounted in said bore for longitudinal sliding movement therealong, said spool having a plurality of lobes arranged such that when said spool is in a null position relative to said body, each of said openings will be covered, said spool being movable off-null in one direction to uncover a first return port communicating said first chamber with said first return opening, to uncover a second bypass port, and to uncover a second supply port communicating said second chamber with said source, said spool being movable off-null in the opposite direction to uncover a second return port communicating said second chamber with said second return opening, to uncover a first bypass port, and to uncover a first supply port communicating said first chamber with said source;

a driver operatively arranged to selectively move said spool to a desired position relative to said body; and a throttling valve operatively arranged to permit flow through the uncovered ones of said supply and return ports only when an applied load opposes the desired direction of actuator movement, and arranged to constrain fluid in the contracting higher pressure actuator chamber to flow through one of said bypass ports into the expanding lower pressure actuator chamber when an applied load aids the desired direction of actuator movement.

45. A servomechanism as set forth in claim 44 wherein each of said supply and return ports has the same gain.

46. A servomechanism as set forth in claim 45 wherein each of said first and second bypass ports has the same gain.

47. A servomechanism as set forth in claim 46 wherein the gain of said bypass ports is substantially greater than the gain of said supply and return ports.

48. A servomechanism as set forth in claim 44 wherein said throttling valve is arranged to prevent flow from said supply when an aiding load is applied to said actuator.

49. A servomechanism as set forth in claim 44 wherein said throttling valve is arranged to prevent flow to return when an aiding load is applied to said actuator.

50. A servomechanism as set forth in claim 44 wherein said throttling valve is arranged to prevent flow from said supply and to prevent flow to return when an aiding load is applied to said actuator.

51. A servomechanism adapted to be associated with a source of pressurized fluid and a return for such fluid, comprising:

a fluid-powered actuator having opposing first and second chambers;

an electrohydraulic servovalve operatively arranged to control the flow of fluid with respect to said actuator chambers; and a throttling valve operatively arranged between said return and said servovalve such that when an external load opposes the desired direction of actuator movement, said servovalve may be operated so as to selectively communicate said source with the higher pressure actuator chamber and to selectively communicate the lower pressure actuator chamber with said return, but when an external load aids the desired direction of actuator movement, said throttling valve will prevent flow to return and will cause fluid in the higher pressure actuator chamber to flow directly through said servovalve to the lower pressure chamber.

52. A servomechanism as set forth in claim 51 wherein said throttling valve is arranged to prevent flow from said source in the case of such aiding external load.

53. A servomechanism as set forth in claim 51 wherein said servovalve controls the flow of fluid from said higher pressure actuator chamber to said lower pressure actuator chamber in the case of such aiding external load.

54. A servomechanism as set forth in claim 51 wherein said throttling valve includes a body provided with a bore, a valve spool mounted in said bore for longitudinal sliding movement therealong and defining first and second spool end chambers, and wherein the pressure in said actuator first chamber is supplied to one of said spool end chambers and the pressure in said actuator second chamber is supplied to the other of said spool end chambers, whereby substantially the same pressure differential between said actuator first and second chambers will exist between said first and second spool end chambers.

55. A servomechanism as set forth in claim 54 and further including a first centering spring arranged in said first spool end chamber and a second centering spring arranged in said second spool end chamber, each of said centering springs acting between said body and the proximate end face of said spool for biasing said spool toward a null position relative to said body.

56. The method of controlling the velocity of a fluid-powered actuator having one member movable relative to another member and separating opposing chambers, comprising the steps of:

causing a supply flow of fluid from a source thereof to the expanding chamber whenever it is desired to cause relative movement between said members;

causing a bypass fow of fluid from the contracting chamber to the expanding chamber whenever and only when a load acting on said one member aids the desired direction of relative movement between said members;

summing said supply and bypass flows in the expanding chamber; and controlling the magnitude of such summed flows.

57. The method as set forth in claim 56 wherein said one member has surfaces of equal area facing into said chambers.

58. The method as set forth in claim 56 wherein said supply flow passes through a variable-orifice supply port, and said bypass flow passes through a variable-orifice bypass port.

59. The method as set forth in claim 58 wherein said supply and bypass ports are opened simultaneously.

60. The method as set forth in claim 58 wherein the orifice areas of said supply and bypass ports are controlled simultaneously.

61. The method as set forth in claim 58 wherein said supply and bypass ports have different gains.

62. The method as set forth in claim 61 wherein the gain of said bypass port is substantially greater than the gain of said supply port.

63. The method as set forth in claim 56 wherein the step of controlling the magnitude of such summed flows, includes the further steps of:

controlling the magnitude of said supply flow; and controlling the magnitude of said bypass flow.

64. The method as set forth in claim 63 wherein said supply flow is controlled such that said bypass flow is augmented by said supply flow so that such summed flows are just sufficient to achieve the desired velocity of said actuator.

65. The method as set forth in claim 64 wherein the magnitude of said bypass flow is maximized and the magnitude of said supply flow is minimized.

66. The method as set forth in claim 65 wherein when the magnitude of said bypass flow is sufficient to achieve the desired velocity of said actuator, the magnitude of said supply flow is zero.

67. The method as set forth in claim 58 and further comprising the step of:

causing a return flow of fluid from the contracting chamber to a fluid return whenever it is desired to cause relative movement between said members.

68. The method as set forth in claim 67 wherein said return flow passes through a variable-orifice return port.

69. The method as set forth in claim 68 wherein said supply and return ports are opened simultaneously.

70. The method as set forth in claim 68 wherein the orifice areas of said supply and return ports are controlled simultaneously.

71. The method as set forth in claim 68 wherein the gains of said supply and return ports are substantially the same.

72. The method as set forth in claim 56 wherein the step of causing said bypass flow includes the further step of:

opening a check valve to permit said bypass flow only when said load aids the desired direction of relative movement between said members.

73. The method of controlling the velocity of a fluid-powered actuator having one member movable relative to another member and separating opposing chambers, comprising the steps of:

controllably varying the orifice areas of supply, return and bypass ports simultaneously;

causing a supply flow of fluid from a source through said supply port to the expanding chamber whenever it is desired to cause relative movement between said members and the pressure differential between said chambers exceeds a first predetermined algebraic value;

causing a return flow of fluid from the contracting chamber through said return port whenever it is desired to cause relative movement between said members and the prssure differential between said chambers exceeds said first algebraic value;

causing a bypass flow of fluid from the contracting chamber through said bypass port to the expanding chamber only when said pressure differential is less than a second predetermined algebraic value;

summing said supply and bypass flows in the expanding chamber; and controlling the magnitude of such summed flows.

74. The method as set forth in claim 73 wherein said one member has surfaces of equal area facing into said chambers.

75. The method as set forth in claim 73 wherein said supply and bypass ports are opened simultaneously.

76. The method as set forth in claim 73 wherein said supply and bypass ports have different gains.

77. The method as set forth in claim 76 wherein the gain of said bypass port is substantially greater than the gain of said supply port.

78. The method as set forth in claim 73 wherein the step of controlling the magnitude of such summed flows includes the further steps of:

controlling the magnitude of said supply flow; and controlling the magnitude of said bypass flow.

79. The method as set forth in claim 73 wherein the magnitude of said supply flow is progressively reduced as said pressure differential changes from said first predetermined valve to said second predetermined value.

80. The method as set forth in claim 79 wherein said bypass flow is maximized and said supply flow is minimized.

81. The method as set forth in claim 73 wherein the step of causing said supply flow includes the further step of:

progressively reducing the magnitude of said supply flow as the magnitude of a load, which acts on said one member to aid the direction of relative movement between said members, increases such that the magnitude of said bypass flow is augmented by a sufficient magnitude of said supply flow to achieve the desired velocity of said actuator.

82. The method as set forth in claim 81 wherein the magnitude of said supply flow is zero when the pressure differential between said chambers is said first value.

83. The method as set forth in claim 73 wherein said second predetermined algebraic value is substantially zero.

84. The method as set forth in claim 80 wherein when the magnitude of said bypass flow is sufficient to achieve the desired velocity of said actuator, the magnitude of said supply is zero.

85. The method of controlling the velocity of a fluid-powered actuator having one member movable relative to another member and separating opposing chambers, said actuator being associated with a fluid source and a fluid return, and wherein said actuator is subjected to an external load which aids the desired direction of actuator movement, comprising the steps of:

selectively controlling the magnitude of a bypass flow of fluid from the contracting actuator chamber to the expanding actuator chamber; and selectively controlling the magnitude of a return flow of fluid from said contracting actuator chamber to said return such that the sum of the magnitudes of said bypass and return flows produces the desired velocity of said actuator.

86. The method as set forth in claim 85, comprising the further step of:

selectively controlling the magnitude of a supply flow from said source to the expanding actuator chamber such that the magnitudes of said supply and bypass flows produce the desired velocity of said actuator.

87. The method as set forth in claim 86 wherein the magnitudes of said supply and return flows are controlled simultaneously.

88. The method as set forth in claim 85 wherein said bypass flow is maximized and said return is minimized.

89. The method as set forth in claim 88 wherein when the magnitude of said bypass flow is sufficient to achieve the desired velocity of said actuator, the magnitude of said supply flow is zero.

* * * * *